US006126344A

United States Patent [19]

Takayama et al.

[11] Patent Number: 6,126,344

[45] Date of Patent: Oct. 3, 2000

[54] TAPE CARTRIDGE AND PRINTING DEVICE

[75] Inventors: Masaji Takayama, Suwa; Kenji Watanabe, Tokyo; Yoshikiyo Furuya, Suwa, all of Japan

[73] Assignees: Seiko Epson Corporation, Tokyo, Japan; King Jim Co., Ltd.

[21] Appl. No.: 08/969,301

[22] Filed: Nov. 13, 1997

Related U.S. Application Data

[62] Division of application No. 08/611,104, Mar. 5, 1996.

[30] Foreign Application Priority Data

| | | | |
|---|---|---|---|
| Oct. 13, 1992 | [JP] | Japan | 4-300301 |
| Oct. 13, 1992 | [JP] | Japan | 4-300302 |
| Feb. 5, 1993 | [JP] | Japan | 5-18754 |

[51] Int. Cl.[7] ..... B41J 11/26

[52] U.S. Cl. ..... 400/615.2; 400/185; 400/611

[58] Field of Search ..... 400/615.2, 586, 400/185, 613, 611, 208

[56] References Cited

U.S. PATENT DOCUMENTS

| | | | |
|---|---|---|---|
| 4,132,485 | 1/1979 | Hess | 400/208 |
| 4,391,539 | 7/1983 | Connoy | 400/208 |
| 4,451,166 | 5/1984 | Frechette | 400/208 |
| 4,511,271 | 4/1985 | Oberto | 400/208 |
| 4,557,617 | 12/1985 | Richardson et al. | 400/208 |
| 4,623,418 | 11/1986 | Gombrich et al. | 156/361 |

(List continued on next page.)

FOREIGN PATENT DOCUMENTS

| | | |
|---|---|---|
| 55087591 | 7/1980 | European Pat. Off. . |
| 0 042 955 | 1/1982 | European Pat. Off. . |
| 0042955 | 1/1982 | European Pat. Off. . |
| 0 078 369 | 5/1983 | European Pat. Off. . |
| 0078369 | 5/1983 | European Pat. Off. . |
| 0272232 | 6/1988 | European Pat. Off. . |
| 0 410 259A1 | 1/1991 | European Pat. Off. . |
| 0410259A1 | 1/1991 | European Pat. Off. . |

(List continued on next page.)

OTHER PUBLICATIONS

IBM Corp., IBM Technical Disclosure Bulletin, "Ribbon Back Check Mechanism", (1985) pp. 6855–6856.

Neues Aus Der Technik, Feb. 15, 1990, No. 1, Wurzburg, DE.

(List continued on next page.)

*Primary Examiner*—John S. Hilten
*Assistant Examiner*—Minh H. Chau
*Attorney, Agent, or Firm*—Beyer Weaver & Thomas, LLP

[57] ABSTRACT

The present invention provides a novel structure of a tape cartridge accommodating a printing tape and an ink ribbon used for printing, which prevents the printing tape from being stuck in a cartridge case or the ink ribbon from being slackened. The tape cartridge of the invention has a mechanism for preventing an end of the tape from being reversely moved back into the cartridge case. A typical structure of the mechanism includes an anti-inversion system which prevents a tape core having a tape wound thereon from rotating in a reverse direction, that is, a direction opposite to a normal rotating direction for printing. The anti-inversion effects are removed when the tape cartridge is set in a printing device such as a tape writer to ensure smooth feeding of the tape for printing. When the tape is forcibly pressed back into the cartridge case, a movable platen clamps the tape between the platen and a fixed wall to prevent reverse movement of the tape. The tape cartridge of the invention also includes an anti-slack mechanism for preventing slack of the ink ribbon through engagement of a ribbon winding core with an anti-rotational engagement piece. Engagement of this anti-slack mechanism is also released when the tape cartridge is set in the printing device.

38 Claims, 23 Drawing Sheets

U.S. PATENT DOCUMENTS

| | | | |
|---|---|---|---|
| 4,651,288 | 3/1987 | Zeising | 364/519 |
| 4,815,875 | 3/1989 | Richardson et al. | 400/208.1 |
| 4,917,514 | 4/1990 | Richardson et al. | 400/120 |
| 4,924,411 | 5/1990 | Kashiwagi | 364/518 |
| 4,966,476 | 10/1990 | Kuzuya et al. | 400/208 |
| 4,983,058 | 1/1991 | Nagae | 400/249 |
| 5,007,749 | 4/1991 | Falconieri et al. | 400/208 |
| 5,022,771 | 6/1991 | Paque | 400/120 |
| 5,078,523 | 1/1992 | McGourty et al. | 400/613 |
| 5,163,764 | 11/1992 | Falconieri et al. | 400/234 |
| 5,192,149 | 3/1993 | Gillio | 400/208 |
| 5,193,919 | 3/1993 | Godo et al. | 400/120 |
| 5,222,818 | 6/1993 | Akiyama et al. | 400/61 |

FOREIGN PATENT DOCUMENTS

| | | |
|---|---|---|
| 0497352A2 | 1/1992 | European Pat. Off. . |
| 0506461A2 | 3/1992 | European Pat. Off. . |
| 0487314A1 | 5/1992 | European Pat. Off. . |
| 0497352A3 | 5/1992 | European Pat. Off. . |
| 0506461A3 | 9/1992 | European Pat. Off. . |
| 0 555 954 A2 | 8/1993 | European Pat. Off. . |
| 99114651 | 11/1999 | European Pat. Off. . |
| 3838934A1 | 11/1988 | Germany . |
| 3916234A1 | 5/1989 | Germany . |
| 55-87591 | 7/1980 | Japan . |
| 58-175671 | 10/1983 | Japan . |
| 60-145056 | of 1985 | Japan . |
| 62-108356 | 7/1987 | Japan . |
| 4-279478 | 2/1991 | Japan . |
| 4237097 | 8/1992 | Japan . |
| 5-92652 | 4/1993 | Japan . |
| 62-109958 | 7/1995 | Japan . |
| 2077970 | 2/1981 | United Kingdom . |

OTHER PUBLICATIONS

PC Magazine, Envelope Printers, Dec. 1, 1988, pp. 221–222.

IBM Technical Disclosure Bulletin, "Method to Display Paper Edges With Pitch Changes in a Word Processor", vol. 27, No. 7, Dec. 1986, New York, p. 3147.

IBM Technical Disclosure Bulletin, "Implicit Object Definition in a Multiple Data Editor" vol. 27, No. 10B, Mar. 1985, New York, p. 6002.

IBM Technical Disclosure Bulletin, "Ribbon Back Check Mechanism" vol. 27, No. 12 May 1985 p. 6855–6856.

Fig. 8

| Tape Width | Depth of detection holes 18K | | |
|---|---|---|---|
| [mm] | 18Ka | 18Kb | 18Kc |
| 6 | S | D | D |
| 9 | D | S | D |
| 12 | S | S | D |
| 18 | D | D | S |
| 24 | S | D | S |

S:Shallow D:Deep

IX-IX End View

XII–XII End View

XIII – XIII End View

TAPE CARTRIDGE AND PRINTING DEVICE

This is a Divisional application of copending prior application Ser. No. 08/611,104 filed on Mar. 5, 1996. (Ser. No. 08/611,104 is a divisional of issued U.S. Pat. No. 5,595,447 (formerly U.S. Ser. No. 08/134,213).

BACKGROUND OF THE INVENTION

1. Field of the Invention

The present invention relates to a tape cartridge for accommodating a long printing tape on which a desirable series of characters are printed, a ribbon cartridge for accommodating an ink ribbon used for printing on the printing tape, and a printing device for detachably receiving the tape cartridge and the ribbon cartridge and printing the desirable series of characters on the printing tape.

2. Description of the Related Art

A printing tape generally accommodated in a tape cartridge is detachably and replaceably set in a printing device for printing a desirable series of letters and characters on the printing tape. Such a tape cartridge generally includes a mechanism for holding a long tape on a cylindrical tape core and feeding a required amount of the tape out of the tape core so as to efficiently accommodate the long tape and smoothly feed the tape to the printing device.

The printing device used with such a tape cartridge has a cutting mechanism for cutting the long tape to be desirable length. The cutting mechanism is typically arranged near a tape outlet to allow the long tape to be cut any desirable position through operation of a lever or the like.

An ink ribbon consumed for printing a desirable series of characters on a sheet or tape is also accommodated in an ink ribbon cartridge, which is detachably and replaceably set in the printing device. Such an ink ribbon cartridge generally includes a mechanism for holding a long ink ribbon on a cylindrical ink ribbon core and winding a used ink ribbon on a ribbon winding core so as to compactly accommodate the long ink ribbon and smoothly feed the ink ribbon to the printing device. Both the ink ribbon core and the ribbon winding core are formed to be rotatable via a driving mechanism formed in the printing device for driving and rotating the ink ribbon core and the ribbon winding core. This, the cartridge is not equipped the driving mechanism, effectively reduces the manufacturing cost of each expendable ink ribbon cartridge.

Under such a condition that the tape cartridge is not set in a printing device, the tape core unintentionally starts rotation due to some vibration or shock to press an end of the tape into a cartridge case. The end of the tape incidentally entering the cartridge case is not easily removed.

Although the cartridge case is to be opened for removal of the tape stuck in the cartridge case, forcible opening of the cartridge case generally accommodating both the tape and the ink ribbon may slacken the ink ribbon or even move the ink ribbon from a predetermined position to damage the whole cartridge.

When the tape cartridge having one end of the tape pressed into the cartridge case is accidentally set in a printing device, the tape held and fed between a platen and a printing head is stuck in the tape cartridge to damage the printing device.

Another problem arises in the printing device; that is, when the user tries to use a cutting mechanism during printing operation, the tape is not smoothly fed but may be stuck in the printing device.

There is also a problem in the ink ribbon cartridge. The ink ribbon core is rotated through engagement with a driving shaft of a driving element formed in the printing device as mentioned above. The ink ribbon core not being set in the printing device is thus easily rotatable due to vibration or shock so as to slacken the ink ribbon. Slack of the ink ribbon damages an ink ribbon driving mechanism of the printing device or lower the printing quality.

A protective sheet or element for interfering with rotation of the ink ribbon core is separately inserted in the ink ribbon core before delivery. Alternatively, a special casing for preventing slack of the ink ribbon is used during delivery and storage of the cartridge. These methods, however, have the following problems.

In the former method, manufacturing and management process of the cartridge is rather complicated, and the user should remove the protective sheet before use of the cartridge. When the user sets the cartridge in the printing device without removing the protective sheet, it may cause damage of the ink ribbon driving mechanism of the printing device.

In the latter method, for example, one or a plurality of engagement pawls are formed in an inner face of a special case for ribbon cartridge. The engagement pawls engage with the ink ribbon core and interfere with rotation of the ink ribbon core. This requires an additional manufacturing and management process to raise the cost of the expendable cartridge.

In such a cartridge, the ink ribbon and the tape are held between the platen and the printing head. When the user forcibly pulls out the tape under non-printing conditions, the ink ribbon joints the tape to be pulled out of the cartridge according to the forcible movement of the tape.

SUMMARY OF THE INVENTION

One object of the invention is to prevent a tape from being pressed into and stuck in a cartridge case of a tape cartridge, thus making a printing device free from troubles due to the stuck tape.

Another object of the invention is to efficiently and securely prevent slack of an ink ribbon due to unintentional rotation of an ink ribbon core in an ink ribbon cartridge.

Still another object of the invention is to prevent an ink ribbon from being pulled out of a cartridge according to a forcible movement of a tape.

The above and other objects are realized by a tape cartridge including a cartridge case for accommodating a long printing tape freely fed out of the cartridge case for printing in response to operation of a printing device, and a mechanism for preventing an end of the printing tape from being reversely moved back into the cartridge case.

The tape cartridge of the invention further includes a tape core on which the long printing tape is wound. The tape core includes, as the reverse movement preventing mechanism, an anti-inversion mechanism for preventing rotation of the tape core in a reverse direction opposite to a feeding direction of the long printing tape for printing. In an alternative structure, the tape core has a flange element with an adhesive inner surface to be in contact with at least one of upper and lower sides of the long printing tape.

The anti-inversion mechanism for preventing reverse movement of the printing tape back into the cartridge case includes an engaging element uprightly formed on an outer face of a flange element of the tape core and an engagement element formed on the cartridge case to be located opposite to the engaging element of the tape core. In another structure, the anti-inversion mechanism includes an engagement member mounted on the cartridge case and an engaging element formed on the tape core to be located opposite to the engagement member of the cartridge case.

Engagement of the engagement member of the cartridge case with the engaging element of the tape core in the anti-inversion mechanism is released when the tape cartridge is set in the printing device. In a preferable structure, the anti-inversion mechanism allows rotation of the tape core in a normal direction identical with the feeding direction of the long printing tape for printing.

In another application of the invention, a tape cartridge includes a cartridge case for accommodating a long printing tape held between a platen and a printing head. The platen is installed in the cartridge case, which has a substantially elliptic aperture for movably receiving a shaft of the platen, and a fixed wall formed in a moving direction of the platen movably fitted in the aperture for holding the printing tape between the platen and the fixed wall. In this structure, a longitudinal axis of the elliptic aperture is located across a feeding direction of the printing tape. When the printing tape is moved to be back into the cartridge case, the platen moves to prevent the printing tape held between the platen and the fixed wall from being moved back into the cartridge case.

The cartridge case preferably includes a predetermined length of a guide element arranged near an outlet of the printing tape formed on the cartridge case and along a feeding path of the printing tape.

In still another application of the invention, a cartridge includes a cartridge case for accommodating a long printing tape and a long ink ribbon used for printing on the printing tape in a printing device. The cartridge includes a cylindrical ink ribbon core for holding the long ink ribbon thereon and a cylindrical ribbon winding core for holding a used ink ribbon wound thereon after printing in the printing device. The cartridge is detachably set in the printing device. The ink ribbon core has an engaging element on a portion exposed under such a condition that the ink ribbon is wound on the ink ribbon core. The cartridge case rotatably supporting the ink ribbon core has an engagement piece to engage with the engaging element of the ink ribbon core to prevent rotation of the ink ribbon core.

A printing device according to the invention includes a cartridge holder unit for detachably receiving a cartridge with a printing tape accommodated therein. The printing tape accommodated in the cartridge is fed with an ink ribbon for printing. The printing device further includes a platen driving shaft engaging with a platen mounted on the cartridge and rotating the platen to feed the printing tape according to rotation of the platen driving shaft, a cutting mechanism for cutting the printing tape fed out of the cartridge according to the rotation of the platen driving shaft at a desirable position, a detection unit for detecting a movement of the cutting mechanism during the rotation of the platen driving shaft, and a stop mechanism for interrupting the rotation of the platen driving shaft when the movement of the cutting mechanism is detected by the detection unit.

In another application, a printing device includes a cartridge holder unit for detachably receiving a cartridge accommodating a printing tape and an ink ribbon core with an ink ribbon wound thereon and fed out of the cartridge for printing. The ink ribbon core has an engaging element formed on a portion exposed under such a condition that the ink ribbon is wound on the ink ribbon core. The cartridge has an engagement piece to engage with the engaging element of the ink ribbon core. The cartridge holder unit of the printing device includes an upright contact projection for being in contact with the engagement piece formed in the cartridge to move the engagement piece in a release direction for releasing the engagement of the engagement piece with the engaging element of the ink ribbon core when the cartridge is mounted on the cartridge holder unit.

In still another application of the invention, a printing device includes a cartridge holder unit for detachably receiving a cartridge accommodating a printing tape and a ribbon winding core with a used ink ribbon wound thereon after printing. The ribbon winding core has a second engaging element formed on a portion exposed under such a condition that the used ink ribbon is wound on the ribbon winding core. The cartridge has a second engagement piece to engage with the second engaging element of the ribbon winding core. The cartridge holder unit of the printing device includes a second upright contact projection for being in contact with the second engagement piece formed in the cartridge to move the second engagement piece in a release direction for releasing the engagement of the second engagement piece with the second engaging element of the ribbon winding core when the cartridge is mounted on the cartridge holder unit.

In another preferable structure of the invention, a printing device includes a cartridge holder unit for detachably receiving a cartridge accommodating a cylindrical ink ribbon core with a long ink ribbon wound thereon, a cylindrical ribbon winding core with the long ink ribbon wound thereon after being used for printing in the printing device, and a long printing tape on which a desirable series of characters are printed by an ink of the ink ribbon. The printing device further includes a printing head for adhesively holding the printing tape and the ink ribbon between a platen and the printing head, a driving unit for feeding the printing tape and rotating the ribbon winding core synchronously with the feed of the printing tape, and a ribbon winding core driving unit for rotating the ribbon winding core according to a pull-out movement of the printing tape under non-printing conditions.

The driving unit of the printing device preferably includes a stepping motor functioning as a driving source, a first transmission mechanism for transmitting rotation of the stepping motor to the platen, and a second transmission mechanism diversified at a predetermined point from the first transmission mechanism for transmitting the rotation of the stepping motor to the ribbon winding core. The ribbon winding core driving unit preferably includes a one-way clutch arranged between the stepping motor and the predetermined point of the first transmission mechanism for interfering with transmission of rotation from the platen.

These and other objects, features, aspects, and advantages of the present invention will become more apparent from the following detailed description of the preferred embodiments with the accompanying drawings.

BRIEF DESCRIPTION OF THE DRAWINGS

FIG. 8 shows a relationship between the width of a tape T accommodated in the tape cartridge 10 and the depth of three detection holes 18K;

DESCRIPTION OF THE PREFERRED EMBODIMENT

Structures and functions of the present invention will become more apparent through description of the following preferred embodiments of the invention.

Figure 1:
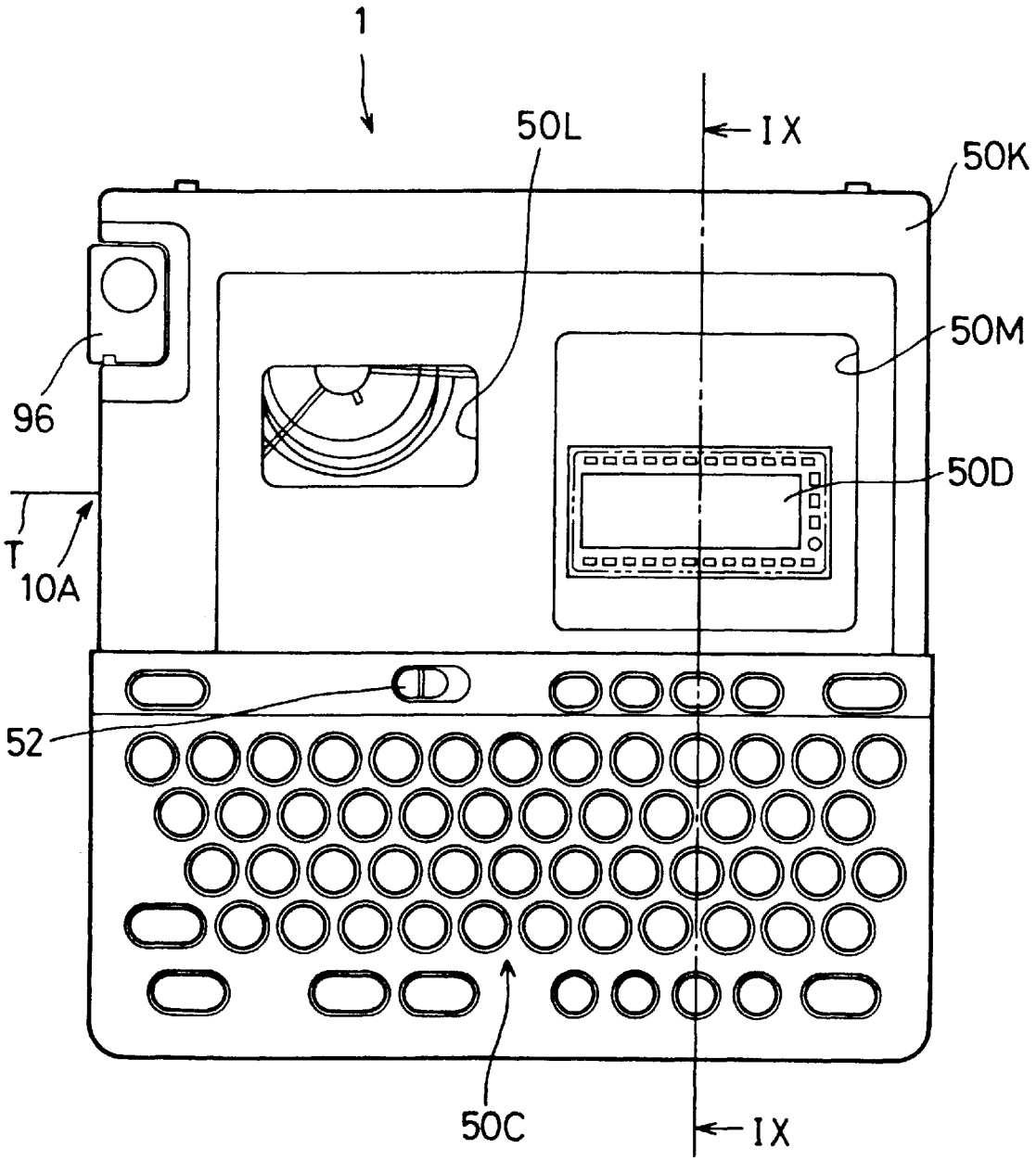
FIG. 1 is a plan view illustrating a tape printing device 1 as a first embodiment according to the invention.
Figure 2:
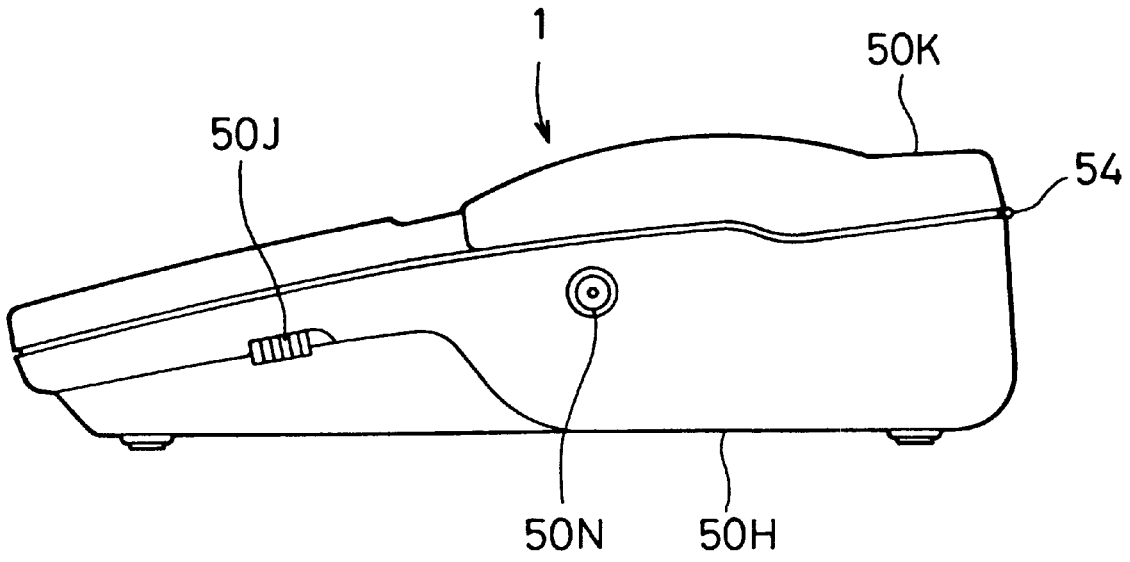
FIG. 2 is a right side view showing the tape printing device 1 of FIG. 1.

FIG. 1 is a plan view illustrating a tape printing device 1 embodying the invention, and FIG. 2 is a right side view of the tape printing device 1. In the description below, the relative position of each constituent, for example, right, left, upper, or lower, corresponds to the drawing of FIG. 1.

A s shown in FIGS. 1 and 2, the tape printing device 1 includes a casing 50H for accommodating a variety of constituents, an input unit 50C having sixty-three keys, a freely openable cover 50K, a display unit 50D arranged visibly through a window 50M of the cover 50K for displaying a series of characters or other required information, and a tape cartridge holder unit 50A (see FIG. 10) disposed on a left upper portion of the device 1, which a tape cartridge 10 is detachably attached to. A window for checking attachment of the tape cartridge 10 is provided on the cover 50K. Both windows 50L and 50M are covered with transparent plastic plates.

Operation of the tape printing device 1 thus constructed is described briefly. In a first step, an operator opens the cover 50K and attaches the tape cartridge 10 to the tape cartridge holder unit 50A. After closing the cover 50K, the operator turns on a power switch 50J externally mounted on a right side wall of a main body of the device 1 as shown in FIG. 2. The device 1 subsequently executes an initial processing to ready for an input of letters or characters. The operator then inputs a desirable series of letters or characters with the keys on the input unit 50C. Although input of letters is implemented directly through key operation of the input unit 50C, an additional process such as conversion from the input letters into Chinese characters may be required in certain linguistic areas using two-bite characters like Chinese characters. When the operator instructs printing through a key operation, the device 1 drives a thermal transfer printer unit 50B to start printing on a tape T fed from the tape cartridge 10. The tape T with the letters or characters printed thereon is fed out of a tape outlet 10A disposed on a left side wall of the tape printing device 1.

The tape T used in the embodiment has a printing surface specifically processed for preferable ink spread by thermal transfer and an adhesive rear face which a peel tape is applied on. After the printed tape T is cut by a desirable length to a label with a built-in blade cutter and the peel tape is peeled off, the label with characters and symbols printed thereon is applied onto any desirable place.

Figure 3:
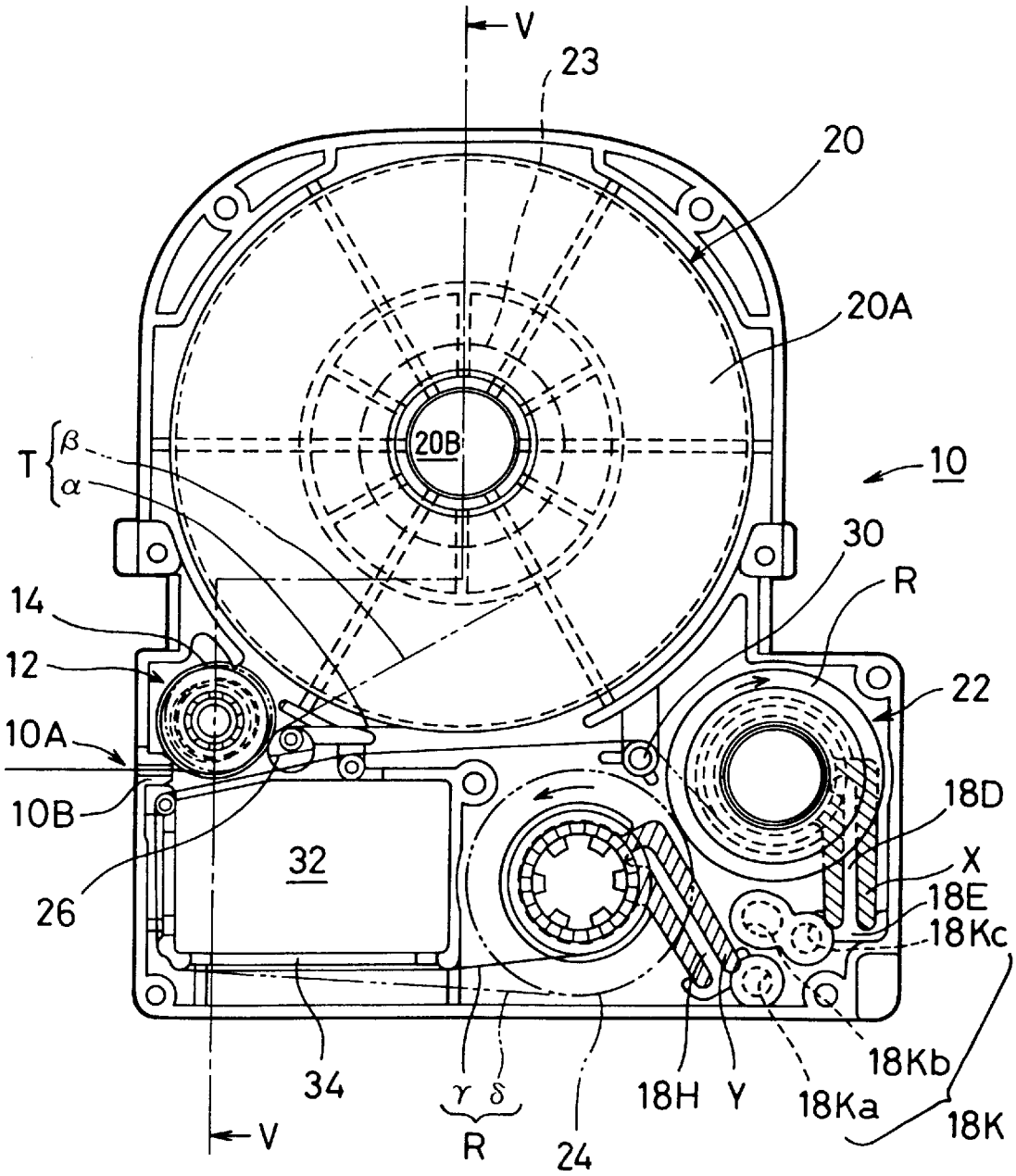
FIG. 3 is a plan view showing assembly of a tape cartridge 10 in the first embodiment.
Figure 4:
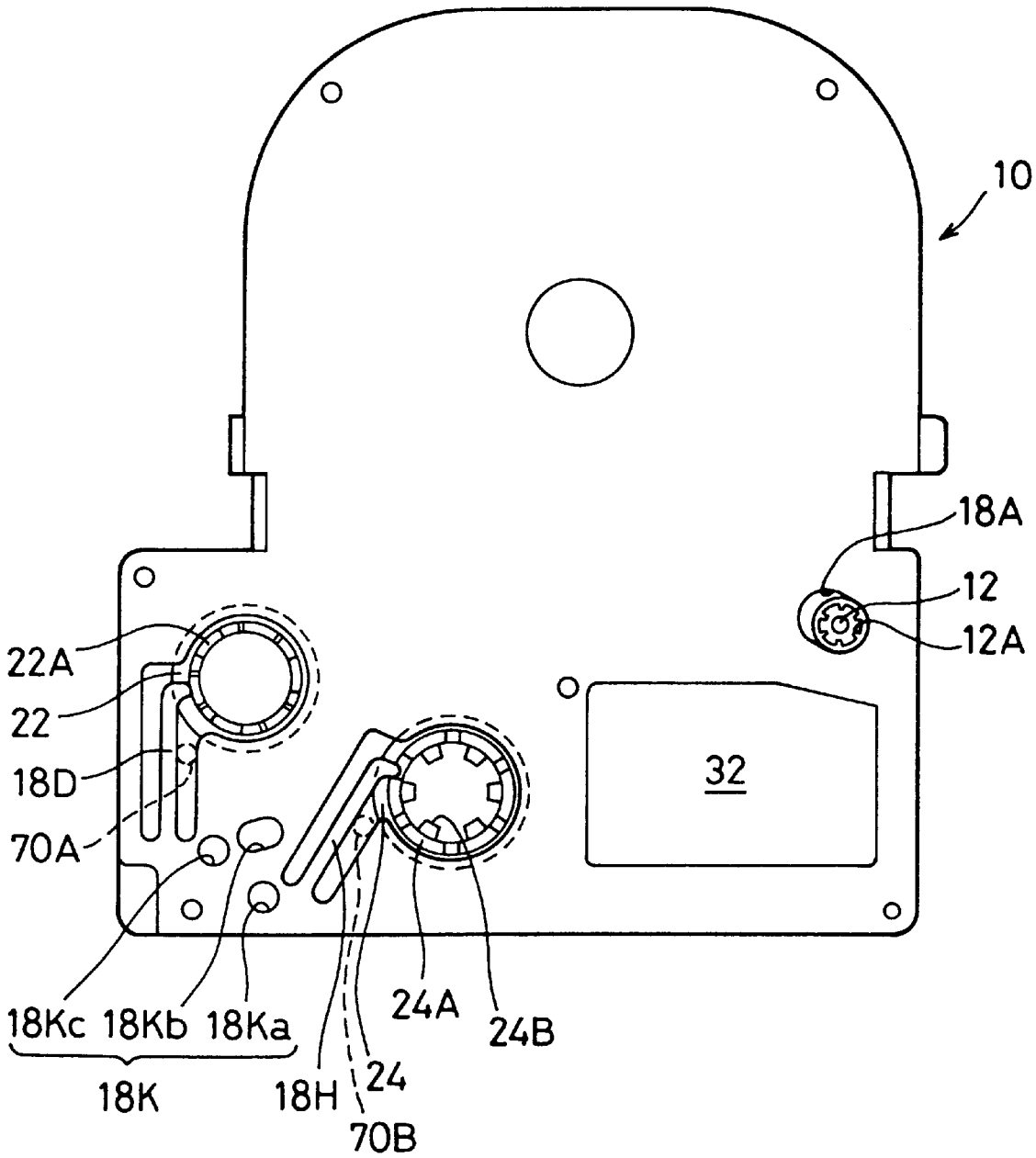
FIG. 4 is a bottom view showing the tape cartridge 10 of FIG. 3.
Figure 5:
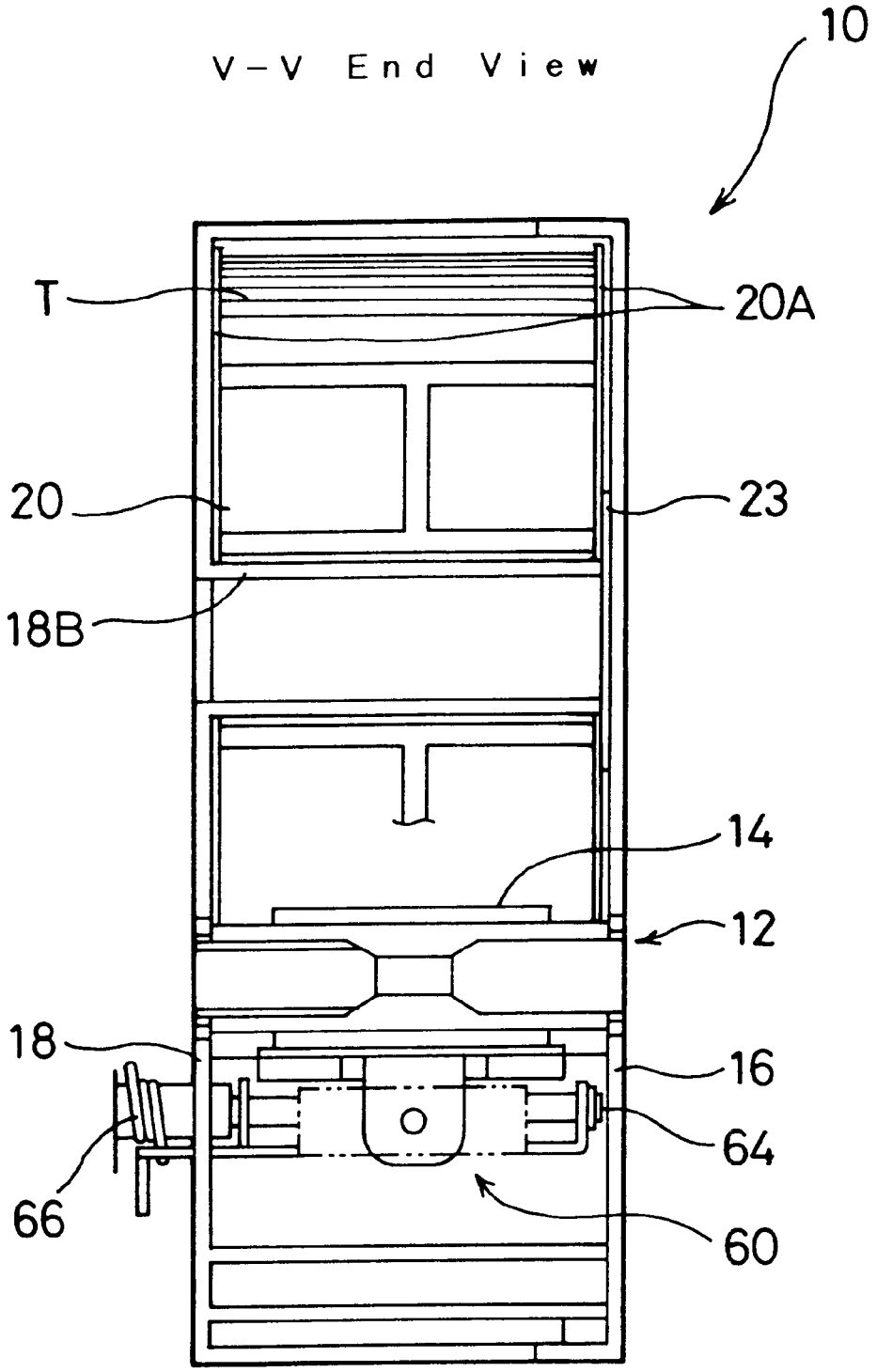
FIG. 5 is an end view illustrating the tape cartridge 10 taken on the line V—V of FIG. 3.
Figure 6:
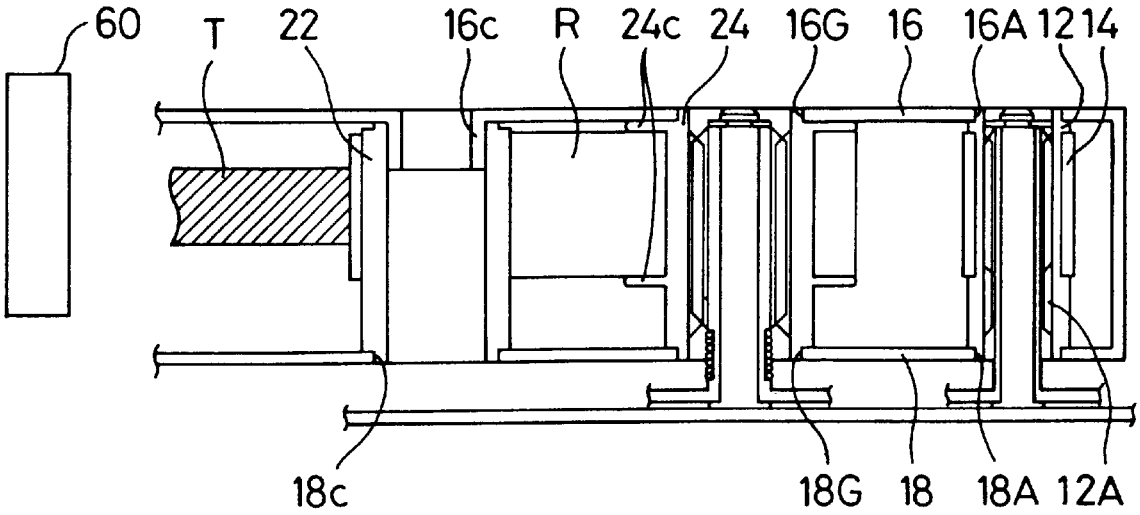
FIG. 6 is an end view showing an internal structure of the tape cartridge 10 with a 6 mm wide tape.
Figure 7:
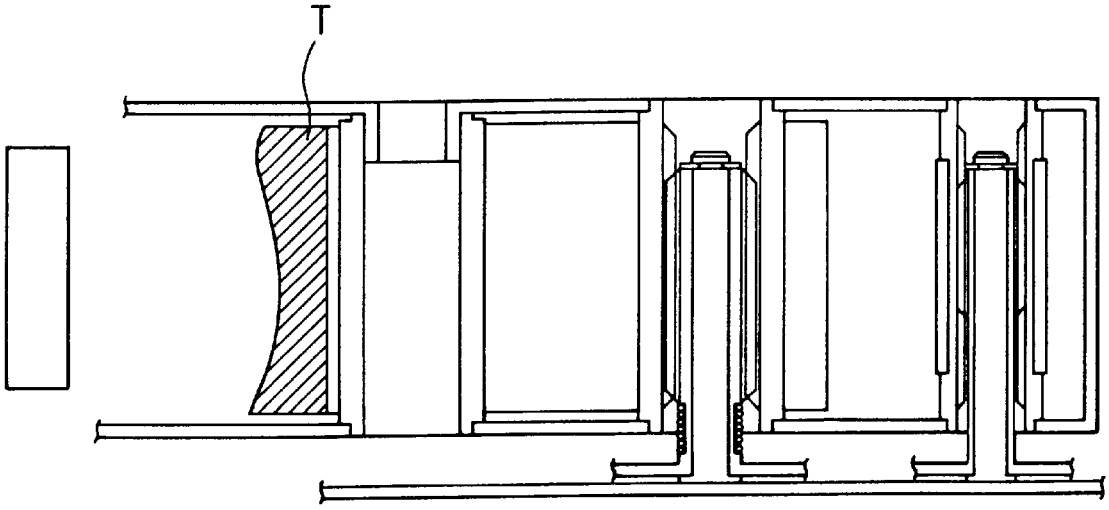
FIG. 7 is an end view showing an internal structure of the tape cartridge 10 with a 24 mm wide tape.

Structure and functions of the tape cartridge 10 are described mainly based on the plan view of FIG. 3, the bottom view of FIG. 4, and the cross sectional view of FIG. 5 taken on the line V—V of FIG. 3. Each tape cartridge 10 having a similar structure can hold a tape of a predetermined width. Five types of tape cartridges for tapes of 6 mm, 9 mm, 12 mm, 18 mm, and 24 mm in width are prepared in the embodiment. FIG. 6 is a partly broken cross sectional view showing an internal structure of the tape cartridge 10, which includes a 6 mm wide tape T running through centers of an ink ribbon core 22, a ribbon winding core 24, and a platen 12. FIG. 7 is also a cross sectional view showing the same with a 24 mm wide tape T. Numbers or symbols representing respective constituents are omitted in FIG. 7 for clarity of the drawing. In FIGS. 6 and 7, part of a printing head 60 is drawn together with the cross section of the tape cartridge 10 to show attachment of the tape T in the tape printing device 1.

The platen 12 is a hollow cylindrical member covered with a platen rubber 14 of a predetermined width corresponding to the width of the tape T. The platen rubber 14 improves contact of the tape T to an ink ribbon R and the printing head 60 for desirable printing. In the embodiment, two types of the platen rubber 14 are used; a 12 mm wide platen rubber for 6 mm, 9 mm, and 12 mm tapes (see FIG. 6), and a 18 mm wide platen rubber for 18 mm and 24 mm tapes (see FIG. 7).

The platen 12 has a smaller-diametrical upper end and a smaller-diametrical lower end. The platen 12 is freely rotatable since the smaller-diametral upper end and the smaller-diametral lower end are rotatably fit in apertures 16A and 18A of a top wall 16 and a bottom wall 18 of the tape cartridge 10, respectively. The apertures 16A and 18A are formed in substantially elliptic shape as seen in FIG. 4. The hollow platen 12 accommodated in the tape cartridge 10 is attached to and detached from a platen driving shaft (described later) disposed in the tape printing device 1 according to attachment and detachment of the tape cartridge 10. The platen 12 has six engagement grooves 12A arranged at the equal intervals on an inner surface thereof along a rotational axis of the platen 12 as shown in FIGS. 4 and 6. The engagement grooves 12A engage with the platen driving shaft to transmit a driving force of the driving shaft.

The tape cartridge 10 is also provided with a tape core 20 which a long tape T is wound on, the ink ribbon core 22, and the ribbon winding core 24. The tape cartridge 10 further includes a printing head receiving hole 32 which the printing head 60 enters and goes in. The printing head receiving hole 32 is defined by a guide wall 34.

The tape core 20 is a hollow, large-diametral cylindrical reel for placing a long tape T wound on a relatively large-diametral bobbin in the tape cartridge 10. Since a total thickness of the wound tape T on the tape core 20 is small as compared with the diametral of the tape core 20, a rotational angular velocity of the tape core 20 for pulling an outer-most wind of the tape T (shown as $\alpha$ in FIG. 3) out of the tape core 20 at a certain rate is approximately same as a rotational angular velocity of the tape core 20 for pulling an inner-most wind of the tape (shown as $\beta$ in FIG. 3) at the same rate. A sufficiently large radius of curvature of tape core 20 allows even a tape T having poor resistance to a bending stress to be wound on the tape core 20 without difficulty.

As shown in FIG. 3, the tape core 20 has a shaft hole 20B on a center thereof, which rotatably receives a shaft member 18A uprightly projecting from the bottom wall 18 of the tape cartridge 10 as clearly seen in FIG. 5. The tape core 20 is provided with a pair of circular thin films 20A respectively applied on axial upper and lower ends of the tape core 20. The thin film 20A has an adhesive layer. Since the film 20A functioning as a flange with respect to the tape T has the adhesive layer facing the tape T, side edges of the tape T lightly adhere to the film 20A. This keeps the roll of the tape T wound when rotation of the platen 12 pulls the tape T out and makes the tape core 20 drivingly rotate.

As shown in FIG. 3, the tape T wound and accommodated in the tape core 20 runs to the platen 12 via a tape guide pin 26 uprightly projecting from the bottom wall 18 of the tape cartridge 10 and goes out of the tape outlet 10A of the tape cartridge 10. The tape outlet 10A has a guide element 10B of a predetermined length formed along a feeding direction of the tape T. While the tape cartridge 10 is set in the tape cartridge holder unit 50A, the printing head 60 is placed in the printing head receiving hole 32. Under such conditions, the tape T is held between the printing head 60 and the platen 12 and fed according to rotation of the platen 12.

The apertures 16A and 18A receiving the upper and lower ends of the platen 12 are formed in elliptic shape as mentioned above, and the platen 12 is movable along longitudinal axes of the apertures 16A and 18A when the tape cartridge 10 is not set in the tape printing device 1. When the tape T outside the tape cartridge 10 is being pressed into the tape cartridge 10, the platen 12 moves along a feeding direction of the tape T. Movement of the platen 12 causes the platen rubber 14 on the platen 12 to be in contact with a circumference of the tape guide pin 26 and securely holds the tape T between the platen rubber 14 and the tape guide pin 26. This interferes with further movement of the tape T. Such a structure effectively prevents the tape T from being mistakenly pressed into the tape cartridge 10.

Winding procedure of the ink ribbon R is now described. The ink ribbon core 22 includes a hollow, small-diametral cylindrical member having smaller-diametral upper and lower ends as clearly seen in FIGS. 6 and 7. The smaller-diametral lower end has six engagement grooves formed as first engaging elements 22A arranged at the equal intervals as shown in FIGS. 3 and 4. The smaller-diametral lower end of the ink ribbon core 22 is loosely fitted in a circular first fitting aperture 18C formed on the bottom wall 18 of the tape cartridge 10. The upper hollow end of the ink ribbon core 22 is loosely fitted in a cylindrical guide projection 16C protruded from the top wall 16 of the tape cartridge 10. The ink ribbon core 22 is accordingly held to be drivingly rotatable according to pull-out of the ink ribbon R.

As shown in FIGS. 3 and 4, a substantially L-shaped first engagement piece 18D is formed on the bottom wall 18 of the tape cartridge 10 to be positioned in the vicinity of the lower ends of the ink ribbon core 22 and the ribbon winding core 24 (described later). The first engagement piece 18D is formed by cutting part of the bottom wall 18 of the tape cartridge 10 (hatched portion designated as X in FIG. 3). Resilience of the material of the bottom wall 18 allows a free end of the first engagement piece 18D to be movable around a base portion 18E integrally formed with the bottom wall 18 along the plane of the bottom wall 18. When no force is applied onto the first engagement piece 18D, the free end of the first engagement piece 18D is positioned inside the circumference of the first fitting aperture 18C and engages with one of the six engaging elements 22A formed on the lower end of the ink ribbon core 22 loosely fitted in the fitting aperture 18C. This effectively prevents the ink ribbon core 22 from being unintentionally rotated and the ink ribbon R from being slack.

The ink ribbon R wound and accommodated in the ink ribbon core 22 is pulled out via a ribbon guide roller 30 and runs along the guide wall 34 to the ribbon winding core 24. In the middle of the ribbon path, the ink ribbon R reaches a position facing the platen 12 to be overlapped with the tape T. In FIG. 3, $\gamma$ and $\delta$ respectively show the running conditions of the ink ribbon R when the tape cartridge 10 is still unused and new, that is, when only a starting end of the ink ribbon R is on the ribbon winding core 24, and when the whole ink ribbon R is wound on the ribbon winding core 24.

The ribbon winding core 24 includes a hollow cylindrical member of substantially the same shape as the ink ribbon core 22 as shown in FIGS. 3 and 4. The hollow cylindrical member has smaller-diametral upper and lower ends in the same manner as the ink ribbon core 22. The lower end has six engagement grooves formed as second engaging elements 24A arranged at the equal intervals. As is the platen 12, the ribbon winding core 24 rotates through engagement with a ribbon winding core driving shaft (described later) disposed in the tape printing device 1. The ribbon winding core 24 thus has six engagement grooves 24B arranged at the equal intervals on an inner surface of the hollow cylindrical member along a rotational axis of the ribbon winding core 24. The smaller-diametral upper and lower ends of the ribbon winding core 24 are loosely and rotatable fitted in a top circular fitting aperture 16G and a bottom circular fitting aperture 18G formed on the top wall 16 and the bottom wall 18 of the tape cartridge 10, respectively.

In the same manner as the ink ribbon core 22, a substantially L-shaped second engagement piece 18H is formed on the bottom wall 18 of the tape cartridge 10 to prevent unintentional rotation of the ribbon winding core 24. The second engagement piece 18H is formed by cutting part of the bottom wall 18 of the tape cartridge 10 (hatched portion designated as Y in FIG. 3). When the tape cartridge 10 is not set in the tape printing device 1, a free end of the second engagement piece 18H is positioned inside the circumference of the bottom fitting aperture 18G and engages with one of the six second engaging elements 24A formed on the lower end of the ribbon winding core 24. The ribbon winding core 24 is thereby not rotated in such a direction as to slacken the ink ribbon R wound thereon. The free ends of the first engagement piece 18D and the second engagement piece 18H are respectively positioned not to be perpendicular but to be inclined to the first and second engaging elements 22A and 24A. This prevents the ink ribbon core 22 and the ribbon winding core 24 from rotating in undesirable directions as described above. The ribbon winding core 24 readily rotates in a normal winding direction of the ink ribbon R.

Engagement of the first engaging element 22A of the ink ribbon core 22 with the first engagement piece 18D and that of the second engaging element 24A of the ribbon winding core 24 with the second engagement piece 18H effectively prevent the ink ribbon R from undesirably slackening while the tape cartridge 10 is not set in the tape printing device 1. The engagement is released when the tape cartridge 10 is set in the tape cartridge holder unit 50A. The releasing procedure is described later with a typical structure of the tape cartridge holder unit 50A.

The ink ribbon R wound on the ribbon winding core 24 is a thermal transfer ribbon having a predetermined width corresponding to the width of the tape T used for printing. In the embodiment, a 12 mm wide ink ribbon R is used for 6 mm, 9 mm, and 12 mm wide tapes T as shown in FIG. 6, a 18 mm wide ink ribbon R for a 18 mm wide tape T (not shown), and a 24 mm wide ink ribbon R for a 24 mm wide tape T as shown in FIG. 7.

When the width of the ink ribbon R is equal to the height of the tape cartridge 10 (see FIG. 7), the top wall 16 and the bottom wall 18 of the tape cartridge 10 guide the ink ribbon R. No additional flange is thus required on the circumference of the ribbon winding core 24 for controlling and adjusting a winding position of the ink ribbon R. When the width of the ink ribbon R is smaller than the height of the tape cartridge 10, on the other hand, a flange 24C is formed on the circumference of the ribbon winding core 24 to guide the ink ribbon R to go through a printing position of the platen 12. The flange 24C is formed in a certain size corresponding to the width of the ink ribbon R.

In the embodiment, there are tape cartridges 10 of five different sizes corresponding to the width of the tape T as described above. Since a printable area of the tape T differs according to the width of the tape T, a variety of condition setting procedures are required. The tape printing device 1 detects the size of the tape cartridge 10 and automatically executes required setting, thus making the user free from troublesome setting. The tape cartridge 10 of the embodiment has first through third detection holes 18Ka, 18Kb, and 18Kc formed on the bottom wall 18 corresponding to the size of the tape T as shown in FIG. 4. Namely, depths of the three detection holes 18Ka, 18Kb, and 18Kc are changed according to the width of the tape T accommodated in the tape cartridge 10.

FIG. 8 shows a relationship between the width of the tape T accommodated in the tape cartridge 10 and the depths of the three detection holes 18Ka, 18Eb, and 18Kc. As shown in FIG. 8, the first detection hole 18Ka is formed shallow and the second and third detection holes 18Kb, 18Kc of the tape cartridge 10 are formed deep for a 6 mm wide tape. The first and third detection holes 18Ka, 18Kc are formed deep for a 9 mm wide tape; only the third detection hole 18Kc is deep for a 12 mm wide tape; and the first and second detection holes 18Ka, 18Kb are deep for a 18 mm wide tape. Only second detection hole 18*kb* is formed deep for a 24 mm wide tape. Since the size of the tape cartridge 10 is designated as a combination of the depths of the three detection holes 18Ka through 18Kc, the user can also check the tape cartridge 10 with eyes.

Figure 9:
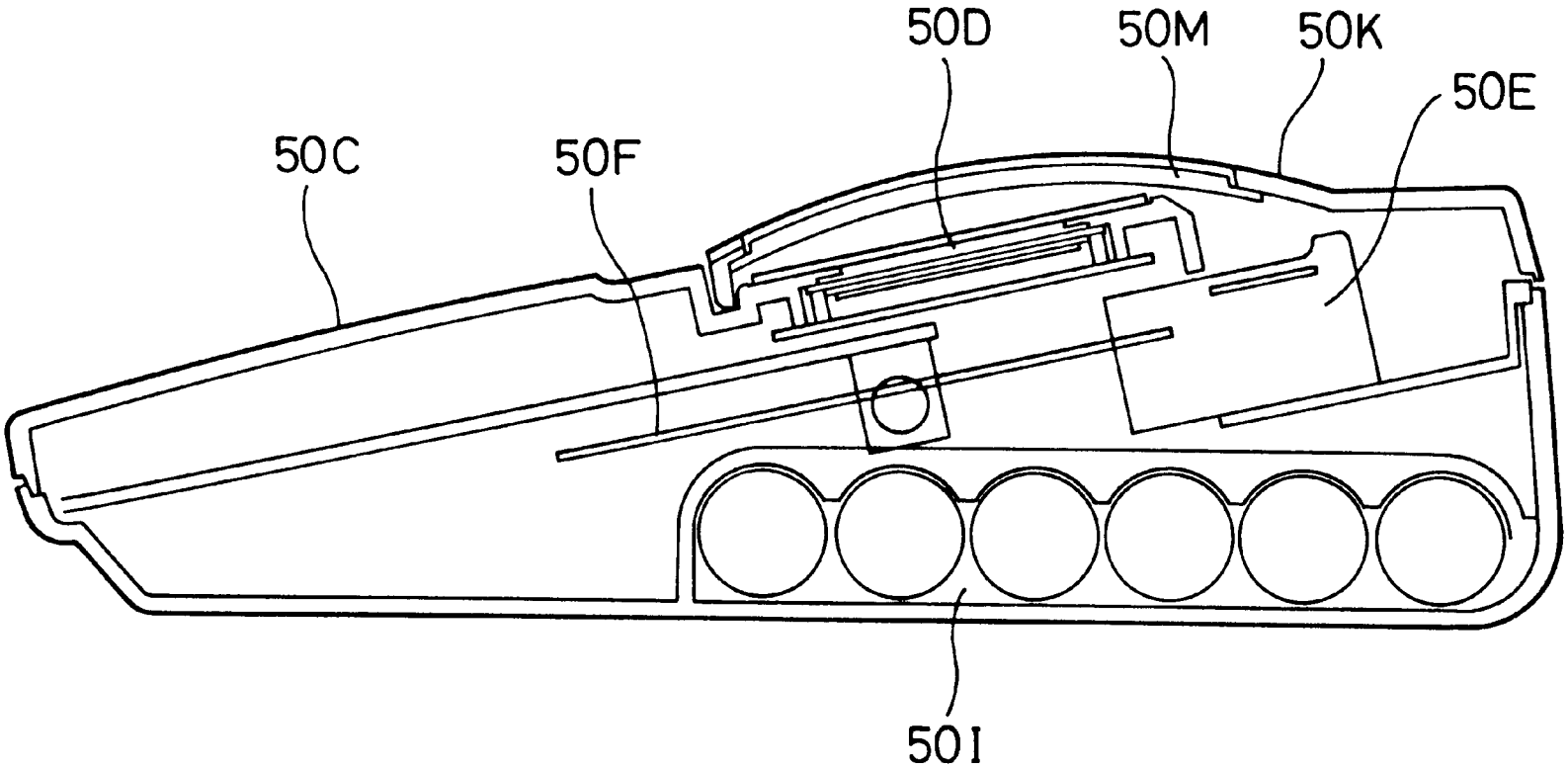
FIG. 9 is an end view illustrating the tape printing device 1 taken on the line IX—IX of FIG. 1.

The tape cartridge 10 thus constructed is set in the tape cartridge holder unit 50A of the tape printing device 1. The tape printing device 1 includes an extension unit 50E for connecting various packs optionally supplied as external memory elements, the input unit 50C, and a control circuit unit 50F for controlling the display unit 50D and the printer unit 50B as shown in the cross sectional view of FIG. 9 taken on the line IX—IX of FIG. 1.

The tape printing device 1 is also provided on a bottom face thereof with a battery holder unit 50I for receiving six SUM-3 cells working as a power source of the whole device 1. The power switch 50J is mounted on the right side wall of the tape printing device 1 (see FIG. 2). Power may be supplied from a plug 50N (see FIG. 2) formed on the right side wall of the device 1 to be connectable with an AC adapter (not shown).

Figure 10:
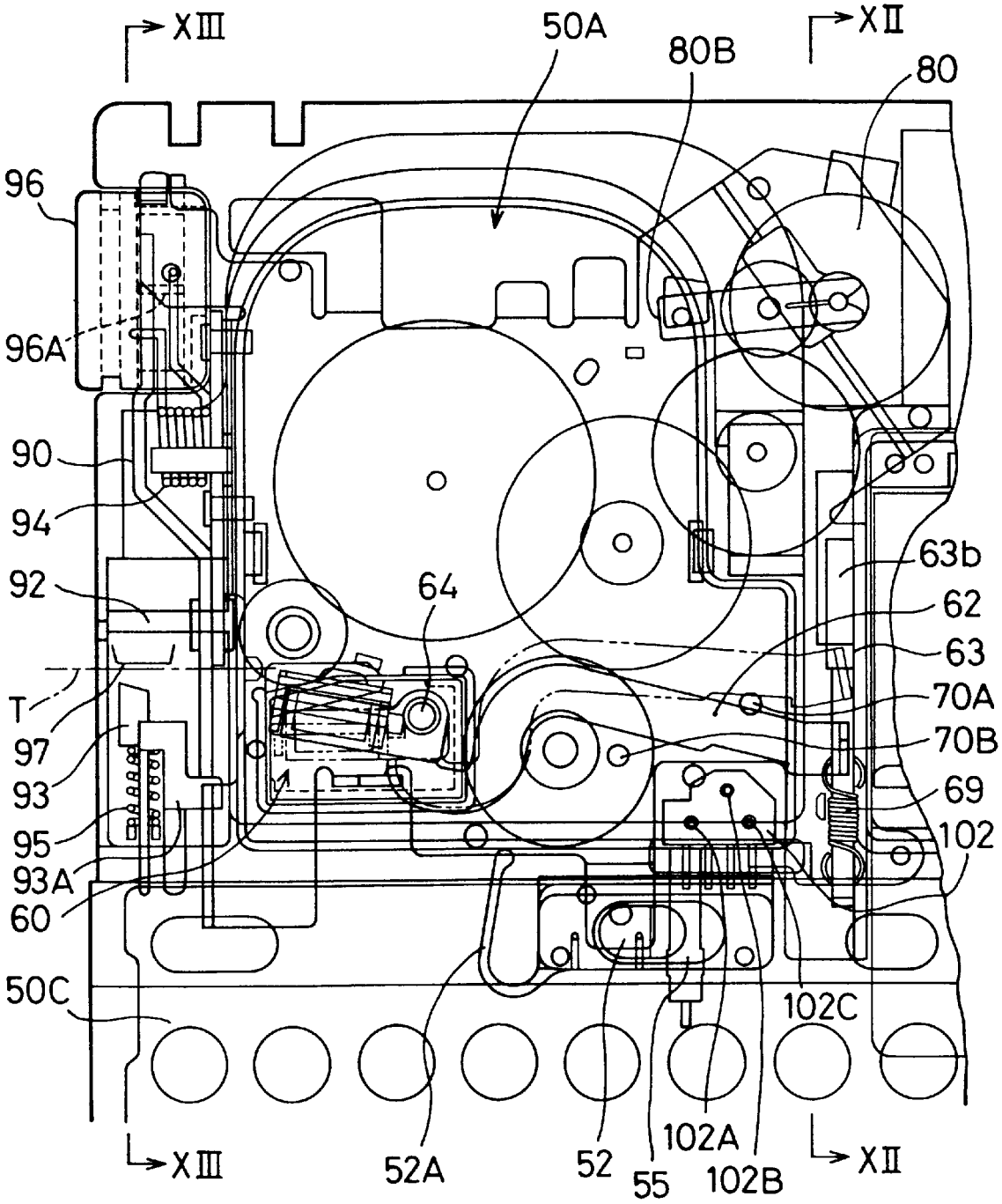
FIG. 10 is a plan view showing a typical structure of a tape cartridge holder unit 50A.
Figure 11:
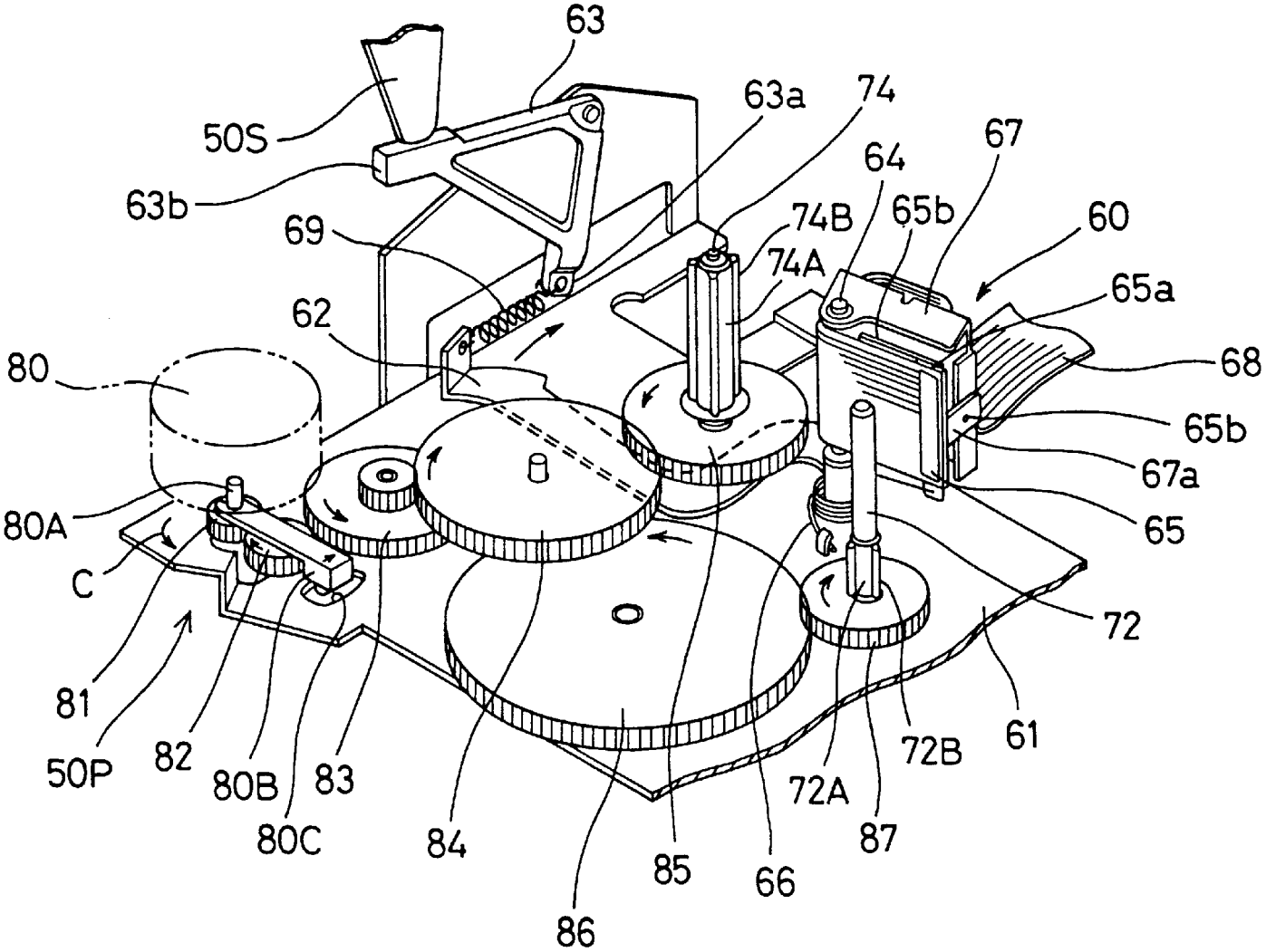
FIG. 11 is a perspective view illustrating a gear train and a mechanism for shifting a printing head 60 between a retreated position and a printing position.

Mechanical constituents of the tape printing device 1 are described hereinafter. FIG. 10 is a plan view showing a typical structure of the tape cartridge holder unit 50A, and FIG. 11 is a perspective view illustrating an essential structure of a driving mechanism 50P for driving the platen 12 and the other elements by means of power of a stepping motor 80.

The tape cartridge holder unit 50A is disposed in a left upper position of a main body of the tape printing device 1 and defines an attachment space corresponding to the shape of the tape cartridge 10 as shown in FIG. 10. The platen driving shaft and the ribbon winding core driving shaft respectively engaging with the hollow members of the platen 12 and the ribbon winding core 24 as well as the printing head 60 are uprightly disposed in the attachment space of the tape cartridge holder unit 50A as shown in FIG. 11. The tape cartridge holder unit 50A is also provided on a lower portion thereof with the driving mechanism 50P for transmitting rotation of the stepping motor 80 to the platen 12 and other elements. The driving mechanism 50P disposed below the tape cartridge holder unit 50A is not observable even when the cover 50*k* is open. FIG. 11 shows the driving mechanism 50P when the inner case of the tape cartridge holder unit 50A is eliminated. The attachment space of the tape cartridge holder unit 50A is covered with the cover 50K while the tape printing device 1 is in service.

The tape cartridge 10 is attached to or replaced in the tape cartridge holder unit 50A while the cover 50K is open. When a slide button 51 (see FIGS. 1 and 10) disposed before the tape cartridge holder unit 50A is slid rightward (in the drawing), engagement of the cover 50K with the main body of the device 1 is released, so that the cover 50K rotates around a cover hinge 54 mounted on a rear portion of the main body of the device 1 to be opened. A spring arm 52A integrally formed with the slide button 52 engages with an engaging element of the main body of the device 1 to continuously apply a leftward (in the drawing) pressing force to the slide button 52.

When the cover 50K is opened through operation of the slide button 52, the printing head 60 for printing the tape T of the tape cartridge 10 is retreated to allow the tape cartridge 10 to be attached or detached. The printing head 60 is rotatably mounted on a head rotating shaft 64 projected from a base board 61 as clearly seen in FIG. 11. The printing head 60 includes a head body 65 having a plurality of heating dot elements, a radiator plate 65*b* holding the head body 65 via an insulator 65*a*, a frame element 67 for supporting the radiator plate 65*b* through a connection plate 67*a,* a coil spring 66 pressing the printing head 60 in an initial direction, and a flexible cable constituting an electric wiring to the head body 65.

The printing head 60 is only roughly aligned with the platen 12 in the tape cartridge 10 through attachment of the tape cartridge 10 in the tape printing device 1. Namely, the printing head 60 is not always in contact with the platen rubber 14 along the height of the platen 12 uniformly when the tape cartridge 10 is set in the device 1. In the tape printing device 1 of the embodiment, the connection plate 67*a* is fixed to the frame element 67 via a pin 67*b* inserted into an opening of the connection plate 67*a,* and the radiator plate 65*b* holding the head body 65 is thus rotatable around the pin 67*b*. This allows the head body 65 to hold the tape T between the platen 12 and the head body 65 and to be uniformly in contact with the height of the platen 12 irrespective of the attachment conditions of the tape cartridge 10 with respect to the tape cartridge holder unit 50A when the printing head 60 is pressed towards the platen 12.

A lower end of the frame element 67 is extended to form a link plate 62. The link plate 62 is positioned in a gear train shown in FIG. 11, and has a free end positioned in the vicinity of a boundary of the display unit 50D (see FIG. 10). The free end of the link plate 62 holds one end of a coil spring 69 to connect a driving member 63 with the link plate 62. The driving member 63 having a substantially triangular shape has a first end 63*a* holding the other end of the coil spring 69 and a second end 63*b* placed opposite to the cover 50K as shown in FIG. 11. An operation arm 50S is extended from the cover 50K to be positioned opposite to the second end 63*b* of the driving member 63, and presses the second end 63*b* when the cover 50K is closed.

Figure 12:
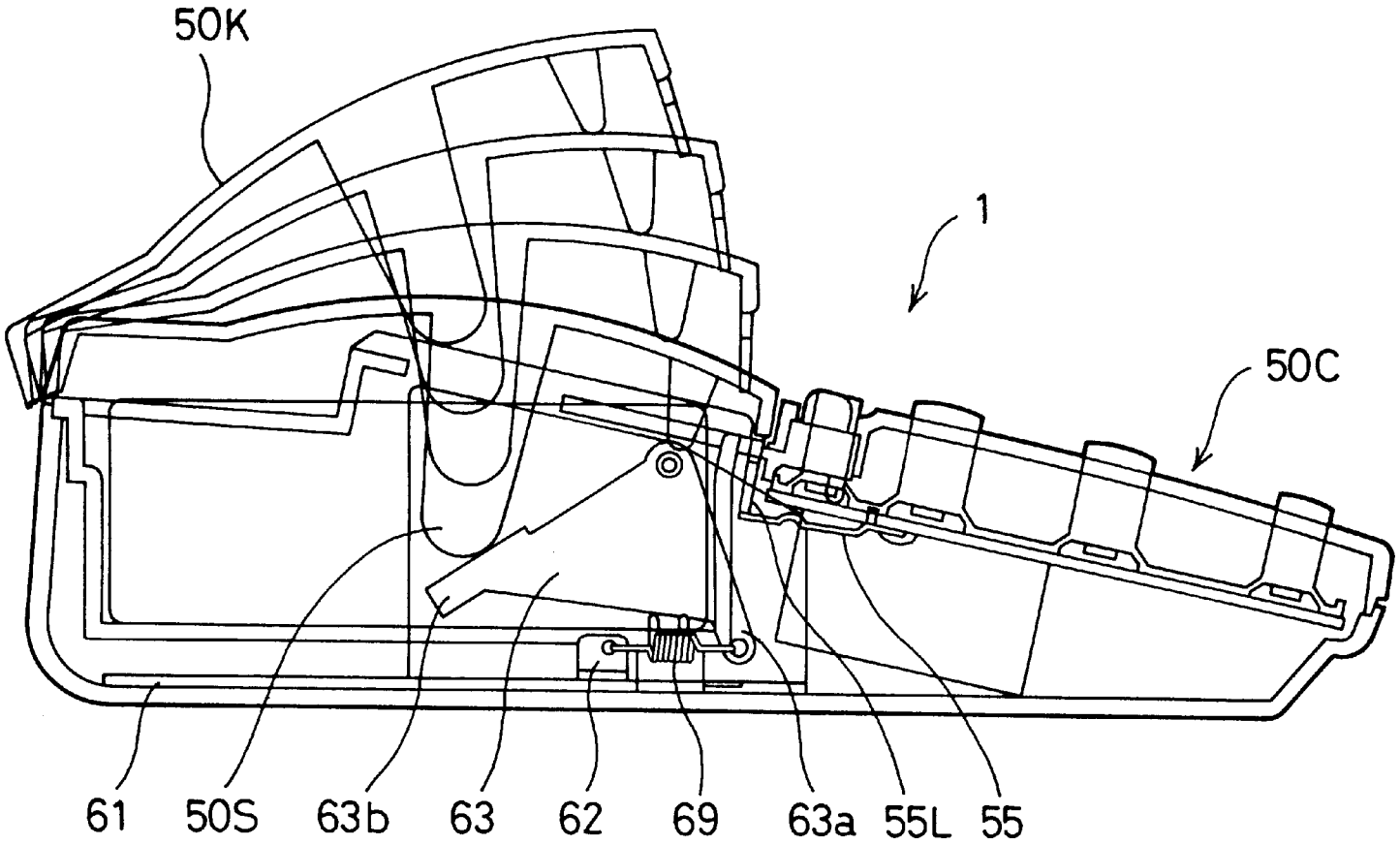
FIG. 12 is an end view showing the mechanism for shifting the printing head 60 taken on the line XII—XII of FIG. 10.

FIG. 12 is a cross sectional view schematically showing such a movement described above, taken on the line XII—XII of FIG. 10. When the cover 50K is pressed downward, the operation arm 50S presses the second end 63*b* of the driving member 63 downward, and the link plate 62 rotatingly moves rightward (in FIG. 11) via the coil spring 69, accordingly. Such a rotating movement of the link plate 62 rotates the printing head 60 against the pressing force of the coil spring 66. The printing head 60 thereby moves from its retreated position to a printing position facing the platen 12 of the tape cartridge 10 set in the tape printing device 1. When the cover 50K is closed, the printing head 60 is accordingly shifted to the printing position. When the cover 50K is opened, on the contrary, the printing head 60 is shifted to the retreated position to allow the tape cartridge 10 to be detached or attached. The printing head 60 once retreated is kept in the retreated position by means of the coil spring 66 while the cover 50K is open, and goes back to the printing position to press against the platen 12 when the cover 50K is closed.

As described previously, the first engagement piece 18D and the second engagement piece 18H are formed on the bottom wall 18 of the tape cartridge 10 to engage with the first engaging element 22A and the second engaging element 24A so as to prevent unintentional rotation of the ink ribbon core 22 and the ribbon winding core 24 (see FIGS. 3 and 4). The first engagement piece 18D and the second engagement piece 18H are formed respectively by cutting the parts of the bottom wall 18 (hatched portions designated as X and Y in FIG. 3). The tape cartridge holder unit 50A has two cone-shaped contact projections 70A and 70B at a position substantially in the middle of the hatched portions X and Y as shown in FIG. 10. When the tape cartridge 10 is set in the tape cartridge holder unit 50A, the contact projections 70A and 70B are fitted in the hatched portions X and Y of the bottom wall 18 of the tape cartridge 10 to press the first and the second engagement pieces 18D and 18H in a direction away from the first engaging element 22A of the ink ribbon core 22 and the second engaging element 24A of the ribbon winding core 24. This pressing movement releases engagement of the first and the second engagement pieces 18D and 18H with the ink ribbon core 22 and the ribbon winding core 24, thus allowing the ink ribbon core 22 and the ribbon winding core 24 to rotate without any additional load.

A transmission mechanism for transmitting rotation of the stepping motor 80 to a platen driving shaft 72 of the platen 12 is described in detail. As shown in FIG. 11, a first gear 81 is attached to a rotational shaft 80A of the stepping motor 80, and a clutch arm 80B engages with the rotational shaft 80A with predetermined friction. The clutch arm 80B, together with a second gear 82 and a third gear 83, constitutes a one-way clutch. When the stepping motor 80 is rotated in a direction shown by the arrow C in FIG. 11, the friction between the rotational shaft 80A and the clutch arm 80B rotates the clutch arm 80B with the second gear 82 in the directions shown by the arrow C to engage with the third gear 83. Rotation of the stepping motor 80 is thus transmitted to the third gear 83. Functions of the one-way clutch will be further described later.

Rotation of the third gear 83 is then transmitted to a fifth gear 85 and a sixth gear 86 via a fourth gear 84 through repeated gear-down operation. A rotational shaft of the fifth gear 85 is connected to a ribbon winding core driving shaft 74 to wind the ink ribbon R according to rotation of the stepping motor 80. A rim 74A actually driving the ribbon winding core 24 is attached to the ribbon winding core driving shaft 74 with a predetermined friction. Under normal operating conditions, the rim 74A rotates with the ribbon winding core driving shaft 74 rotated by the stepping motor 80. When the ribbon winding core 24 is made unrotatable, for example, due to completion of winding of the ink ribbon R, on the other hand, the rim 74A slips against rotation of the ribbon winding core driving shaft 74.

Rotation of the sixth gear 86 is further transmitted to a seventh gear 87 to rotate the platen driving shaft 72. The platen driving shaft 72 has a rim 72A which engages with the inner surface of the platen 12 to rotate the platen 12. Rotation of the stepping motor 80 transmitted to the third gear 83 by means of the one-way clutch finally rotates the platen driving shaft 72 and the ribbon winding core driving shaft 74, accordingly. The tape T held between the platen rubber 14 on the circumference of the platen 12 and the head body 65 of the printing head 60 is thus continuously fed with progress of printing, and the ink ribbon R is wound on the ribbon winding core 24 synchronously with feeding of the tape T.

The platen driving shaft 72 has, on an outer surface thereof, three engagement projections 72B which are formed at the equal intervals to engage with the engagement grooves 12A formed on the inner surface of the platen 12. The ribbon winding core driving shaft 74 also has three engagement projections 74B which are formed at the equal intervals on an outer surface thereof to engage with the engagement grooves 24B formed on the inner surface of the ribbon winding core 24. When the platen driving shaft 72 and the ribbon winding core driving shaft 74 are rotated at a predetermined rate by the stepping motor 80, the tape T and the ink ribbon R are respectively pulled by a predetermined amount out of the tape core 20 and the ink ribbon core 22 to be overlapped with each other and go through the platen rubber 14 and the printing head 60. In the meanwhile, power supplied to the printing head 60 controls heating of the dot elements on the printing head 60 to melt ink of the ink ribbon R corresponding to the heated dot elements. The melted ink is then thermally transferred to the tape T to complete printing on the tape T. After printing, the tape T with the print is fed out from the tape cartridge 10 while the ink ribbon R used for printing is wound on the ribbon winding core 24.

The tape T conveyed with progress of printing is finally fed out of the tape outlet 10A disposed on the left side wall of the main body of the tape printing device 1. The tape T with the print is normally cut with a cutting mechanism (described later). There is, however, a possibility that the user forcibly pulls out the tape T prior to cutting. Since the printing head 60 presses the tape T against the platen rubber 14 of the platen 12 while the cover 50K is closed, the forcible pull-out of the tape T makes the platen driving shaft 72 rotate. The gear-down operation and a certain amount of retaining torque of the stepping motor 80, however, prevent rotation of the platen driving shaft 72 and the ribbon winding core driving shaft 74 in a conventional driving mechanism. The forcible pull-out of the tape leads to unintentional pull-out of the ink ribbon R, accordingly. When the tape T is cut with the cutting mechanism under such circumstances, the ink ribbon R is also cut undesirably. This makes the tape cartridge 10 unusable any more.

In the embodiment, the one-way clutch including the clutch arm 80B, the second gear 82, and the third gear 83 solves such a problem. When the user forcibly pulls out the tape T, the platen driving shaft 72 rotates with the platen 12 in the structure of the embodiment. Rotation of the platen driving shaft 72 is transmitted to the third gear 83 via the gear train to rotate the third gear 83 clockwise. Rotation of the third gear 83 makes the second gear 82 rotate. However, since the rotational shaft 80A of the stepping motor 80 is not rotated, a rotational force of the third gear 83 presses the clutch arm 80B supporting the second gear 82 to release engagement of the third gear 83 with the second gear 82. This results in separating the third through seventh gears 83 through 87 from the stepping motor 80 to allow the ribbon winding core driving shaft 74 to rotate with rotation of the platen driving shaft 72 due to pull-out movement of the tape T. The rotation of the ribbon winding core driving shaft 74 makes the ink ribbon R wound on the ribbon winding core 24 with pull-out of the tape T, thus effectively preventing unintentional pull-out of the ink ribbon R with the tape T. When the stepping motor 80 starts rotating, the clutch arm 80B is shifted again towards the third gear 83 to engage the second gear 82 with the third gear 83. Since a free end of the clutch arm 80B is fitted in an opening 80C formed on a base 61 as shown in FIG. 11, the movement of the clutch arm 80B is defined in a relatively small range. This moving range is, however, sufficient to make the clutch arm 80B function as the one-way clutch.

Figure 13:
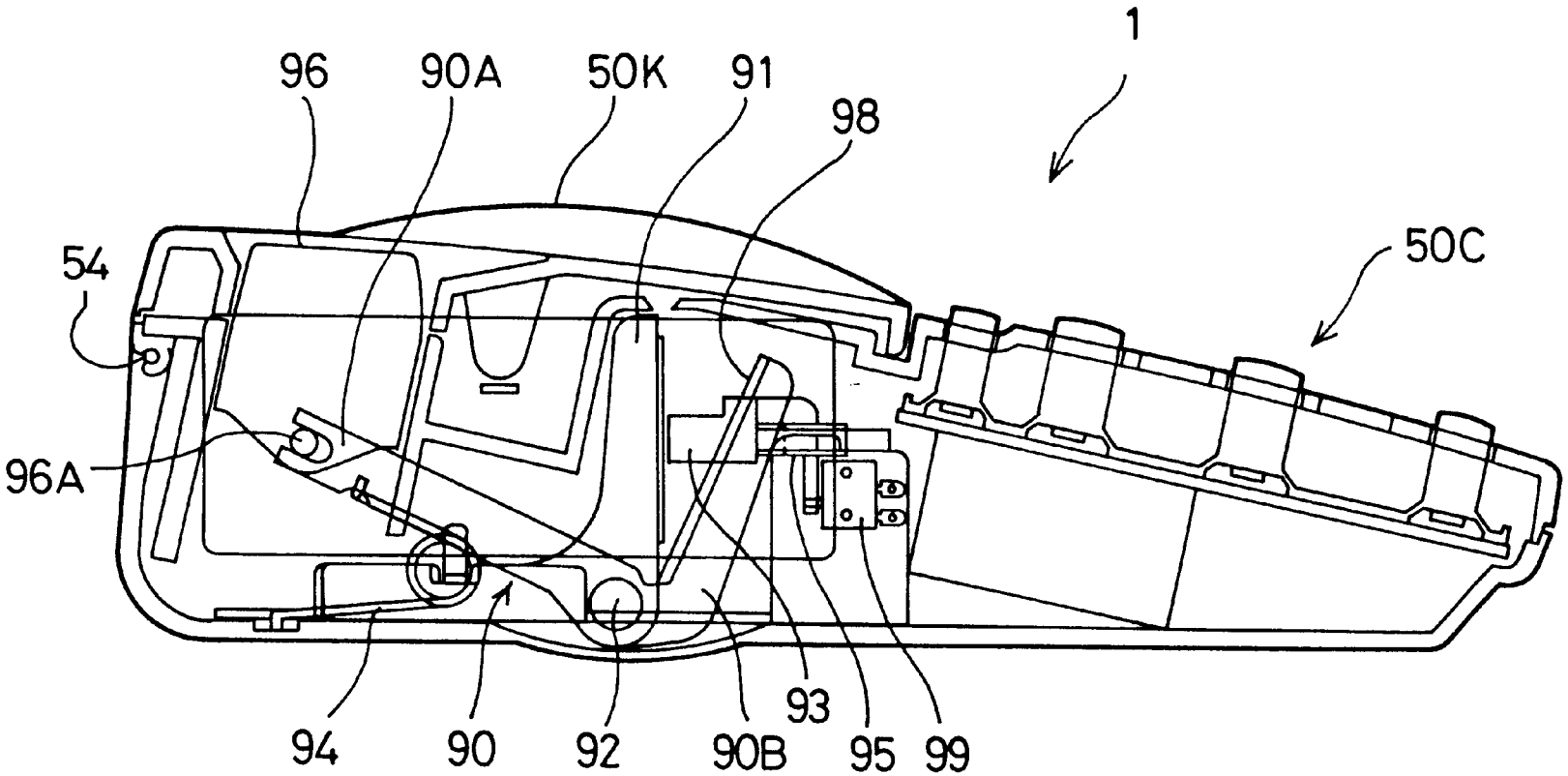
FIG. 13 is an end view showing a cutting mechanism taken on the line XIII—XIII of FIG. 10.

The tape T with the print fed leftward out of the tape cartridge 10 is readily cut with the cutting mechanism, which is shown in detail in FIGS. 10 and 13. FIG. 13 is a cross sectional view mainly showing the cutting mechanism, taken on the line XIII—XIII of FIG. 10. A cutter support shaft 92 protruded from a bottom face of the tape cartridge holder unit 50A holds a substantially L-shaped, pivotably movable tape cutter 90 and a spring 94. A resilient force of the spring 94 keeps the tape cutter 90 under such a condition that a clockwise rotational force is applied onto the tape cutter 90 as shown by the solid line in FIG. 13. With this clockwise rotational force, a left end 90A of the tape cutter 90 presses a cutter button 96 upward. The left end 90A of the tape cutter 90 is formed in a fork shape to receive a pin 96A mounted on a rear face of the cutter button 96. When the cutter button 96 is pressed downward, the left end 90A of the tape cutter 90 shifts downward, accordingly.

A right end 90B of the tape cutter 90 has a movable blade 98 for cutting the tape T, which is arranged at a predetermined angle apart from a fixed blade 91 attached to a side face of the tape cartridge holder unit 50A. A shoulder 93A of a tape support finger 93 (see FIG. 10) is in contact with a rear face of the right end 90B of the tape cutter 90. The tape support finger 93 is pressed against a feeding path of the tape T by a spring 95 as shown in FIG. 10. When the tape cutter 90 rotates to shift the movable blade 98 towards the fixed blade 91, the tape support finger 93 moves towards the feeding path of the tape T. A fixed wall 97 is disposed opposite to the tape support finger 93 across the feeding path of the tape T. The tape T is fixed between the tape support finger 93 and the fixed wall 97 prior to cutting of the tape T by the movable blade 98 and the fixed blade 91. Movement of the tape support finger 93 is detected by a detection switch 99, which prevents printing during the cutting operation of the tape T as described later.

The tape T is cut by pressing the cutter button 96 downward against the resilient force of the spring 94. When the cutter button 96 is pressed downward to rotate the tape cutter 90 counterclockwise (in FIG. 13), the movable blade 98 formed on the right end 90B of the tape cutter 90 also rotates counterclockwise. The tape support finger 93 and the fixed wall 97 securely hold the tape T therebetween, and the movable blade 98 is gradually overlapped with the fixed blade 91 to cut the tape T.

Figure 14:
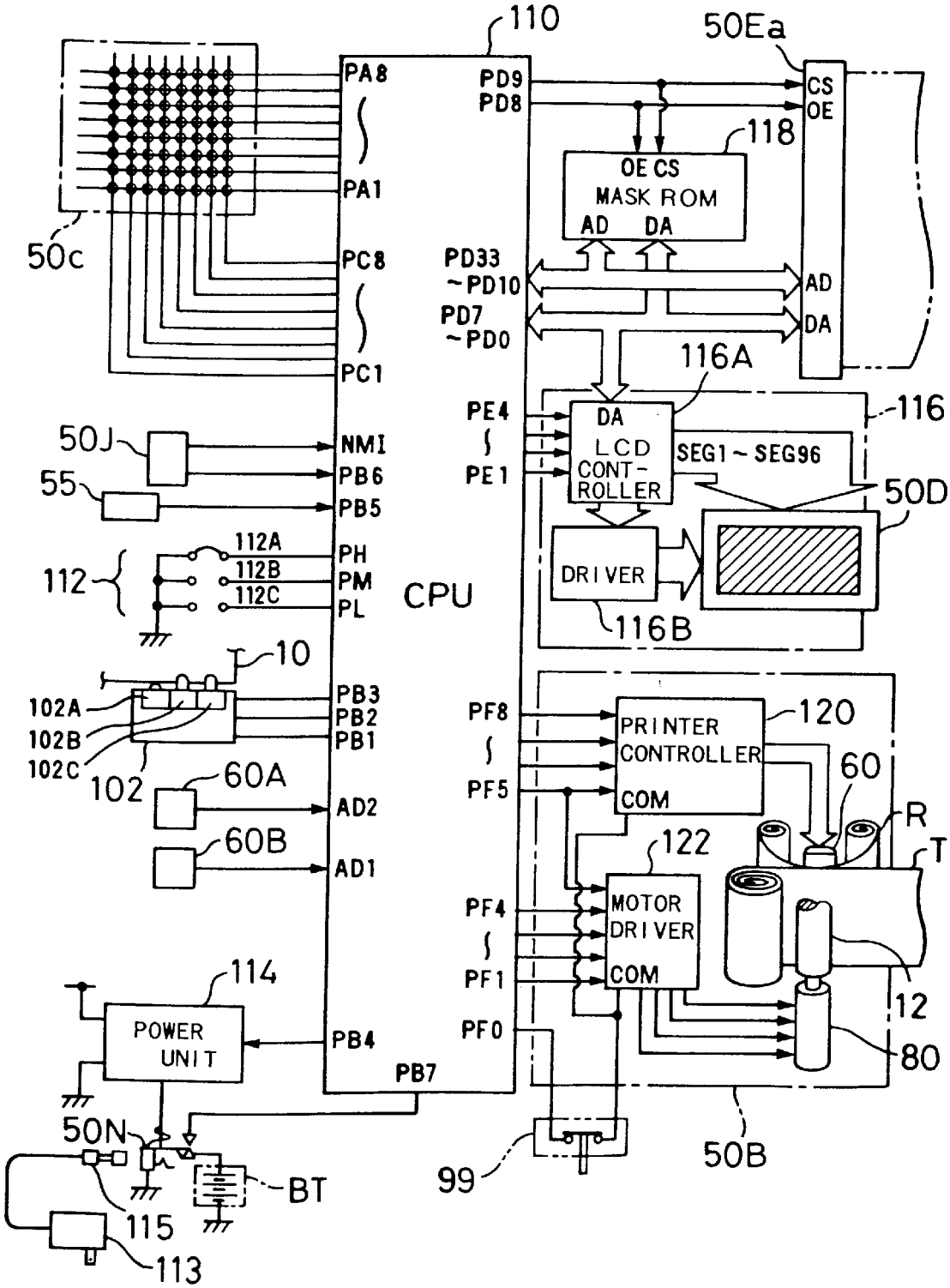
FIG. 14 is a block diagram showing an circuitry structure of tape printing device 1.

Details of the input unit 50C, the display unit 50D, and the printer unit 50B incorporated in the tape printing device 1 are described below after brief description of an electrical structure of the various units including the control circuit unit 50F. The control circuit unit 50F constituted as a printed circuit board is installed with the printer unit 50B immediately below the cover 50K. FIG. 14 is a block diagram schematically showing the general electric structure of the various units. The control circuit unit 50F of the tape printing device 1 includes a one-chip microcomputer 110 (hereinafter referred to as CPU) having a ROM, a RAM, and input and output ports integrally incorporated therein, a mask ROM 118, and a variety of circuits functioning as interfaces between the CPU 110 and the input unit 50C, the display unit 50D, and the printer unit 50B. The CPU 110 connects with the input unit 50C, the display unit 50D, and the printer unit 50B directly or the interface circuits to control these units.

Figure 15:
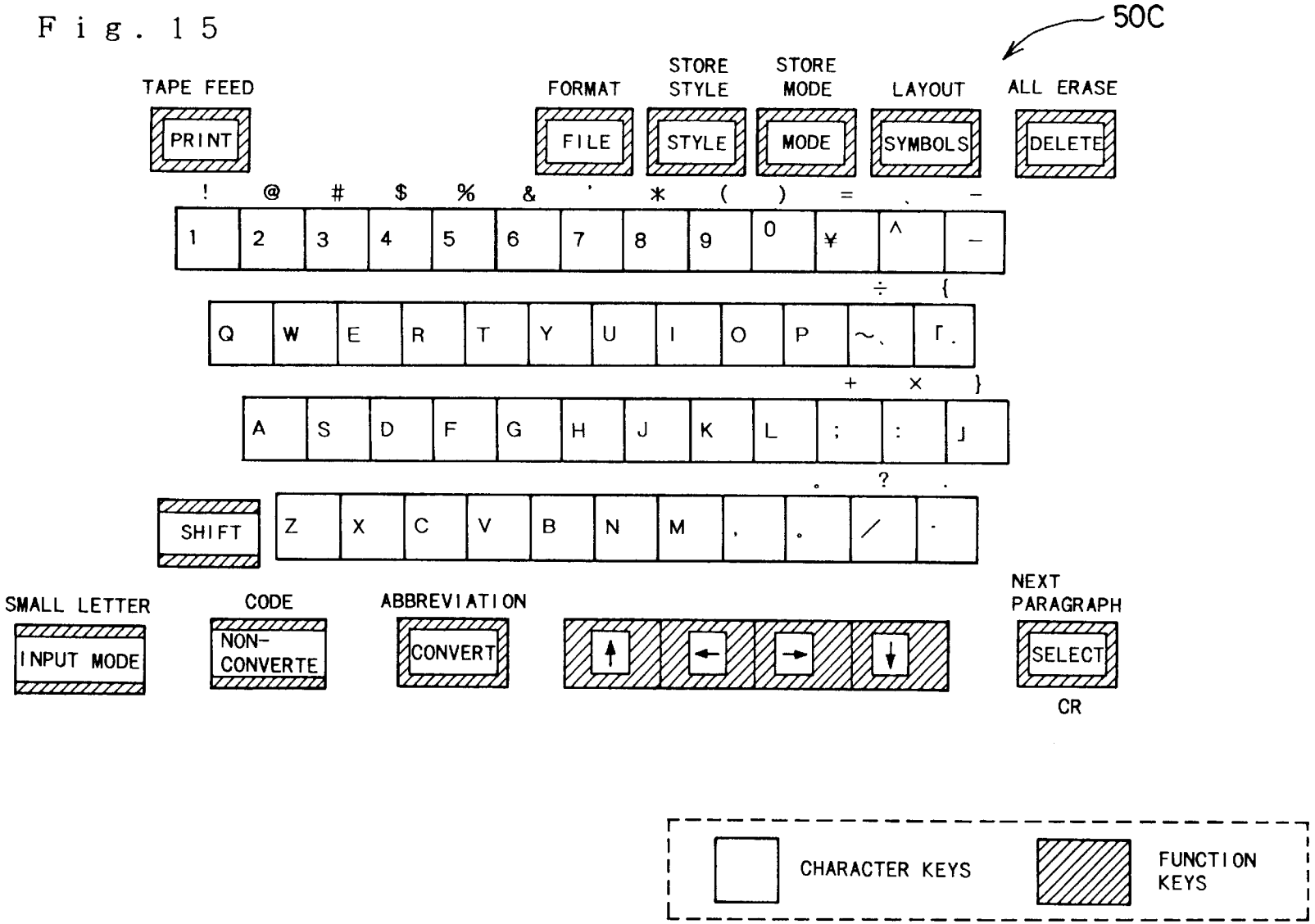
FIG. 15 shows a typical example of a key arrangement on an input unit 50C.

The input unit 50C has forty-eight character keys and fifteen functions keys, sixty-three keys in total, as shown in FIG. 15. The character keys form a so-called full-key structure according to a JIS (Japanese Industrial Standards) arrangement. Like a conventional word processor, the input unit 50C has a commonly known shift key to avoid undesirable increase in the number of keys. The functions keys enhance the ability of the tape printing device 1 by realizing quick execution of various functions for character input, editing, and printing.

These character keys and the function keys are allocated to an 8×8 matrix. As shown in FIG. 14, sixteen input ports PA1 through PA8 and PC1 through PC8 of the CPU 110 are divided into groups, and the sixty-three keys of the input unit 50C are arranged at the respective intersections of the input ports. The power switch 50J is formed independently of the matrix keys and connects with a non-maskable interrupt NMI of the CPU 110. When the power switch 50J is operated, the CPU 110 starts non-maskable interruption to supply or shut off the power.

An output from an opening/closing detection switch 55 for detecting opening and closing of the cover 50K is input to a port PB5, so that the CPU 110 interrupts to monitor the opening and closing conditions of the cover 50K. The opening/closing detection switch 55 detects the movement of the cover 50K according to a movement of an opening/closing detection switch engagement projection 55L (see FIG. 12) disposed on an end of the cover 50K. When the opening/closing detection switch 55 detects opening of the cover 50K while the printing head 60 is driven, the CPU 110 displays a predetermined error command on a main display element 50Da (see FIG. 16) of the display unit 50D and cuts the power to supply to the printer unit 50B.

Ports PH, PM, and PL of the CPU 110 are connected with a head rank detection element 112 which adjusts a varied resistance of the printing head 60 by means of a software. The resistance of the printing head 60 significantly varies according to the manufacture process, which changes a power-supply time required for printing of a predetermined density. The head rank detection element 112 measures the resistance of the printing head 60 to determine a rank of the printing head 60 and set three jumper elements 112A, 112B, and 112C of the head rank detection element 112 based on the measurement results. The CPU 110 then reads the conditions of the head rank detection element 112 to correct a driving time or heating amount of the printing head 60, thus effectively preventing the varied density of printing.

Since the printer unit 50B implements thermal transfer printing, the density of printing varies with a temperature and a driving voltage as well as the power-supply time of the thermal printing head 60. A temperature detection circuit 60A and a voltage detection circuit 60B respectively detect the temperature and the driving voltage. These circuits 60A and 60B are integrally incorporated in the printing head 60 and connect with two-channel analog-digital conversion input ports AD1 and AD2 of the CPU 110. The CPU 110 reads voltages input and converted to digital signals through the input ports AD1 and AD2 to correct the power-supply time of the printing head 60.

A discriminating switch 102 disposed on a right lower corner of the tape cartridge holder unit 50A (see FIG. 10) is connected with ports PB1 through PB3 of the CPU 110. The discriminating switch 102 includes three cartridge discriminating switch elements 102A, 102B, and 102C respectively inserted into the three detection holes 18Ka, 18Kb, and 18Kc formed on the tape cartridge 10. Projections of the cartridge discriminating switch elements 102A, 102B, and 102C are designed according to the depths of the detection holes 18K formed on the bottom wall 18 of the tape cartridge 10. When the cartridge discriminating switch element 102 is inserted in a shallow detection hole 18K, the cartridge discriminating switch element 102 is in contact with and pressed by the detection hole 18K to be turned ON. When the cartridge discriminating switch element 102 is inserted in a deep detection hole 18K, on the other hand, the cartridge discriminating switch element 102 is loosely fitted in the detection hole 18K to be kept OFF. The CPU 110 determines the type of the tape cartridge 10 set in the tape cartridge holder unit 50A, that is, the width of the tape T accommodated in the tape cartridge 10 according to conditions of the three cartridge discriminating switch elements 102A, 102B, and 102C of the discriminating switch 102. Tape width information representing the width of the tape T is used for determining a printed character size and controlling the printer unit 50B (described later).

A port PB7 of the CPU 110 receives a signal from a contact of the plug 50N. While the plug 50N receives direct current from an AC adapter 113 through insertion of a jack 115, power supply from a battery BT to a power unit 114 is cut by means of a braking contact to avoid power consumption of the battery BT. In the meantime, a signal output from the contact on the plug 50N is input to the port PB7 of the CPU 110. The CPU 110 reads the signal to determine whether power is supplied from the AC adapter 113 or the battery BT and execute required controls. In the embodiment, when power is supplied from the AC adapter 113, a printing speed of the printer unit 50B is set at a maximum value. When power is supplied from the battery BT, on the other hand, the printing speed of the printer unit 50B is slowed down to reduce an electric current peak supplied to the printing head 60 and save power of the battery BT.

The twenty four mega-bit mask ROM 118 connected to an address bus and data bus of the CPU 110 stores four different fonts of 16×16 dots, 24×24 dots, 32×32 dots, and 48×48 dots. The mask ROM 118 stores alphabetical types such as elite, pica, and courier as well as Chinese characters and other specific characters and symbols required in the respective countries. A 24 bit address bus AD, an 8 bit data bus DA, a chip selecting signal CS, an output enabling signal OE of the mask ROM 118 are connected with ports PD0 through PD33 of the CPU 110. These signals are also input to an external input/output connector 50Ea to allow the extension unit 50E attached to the external input/output connector 50Ea to be accessible in a similar manner to the mask ROM 118.

The extension unit 50E directly connectable with the control circuit unit 50F receives a ROM pack or RAM pack optionally supplied as an external memory element. The control circuit unit 50F is electrically connected with the external input/output connector 50Ea through insertion of the ROM pack or RAM pack into a slot of the extension unit 50E, so that information is transmittable between the CPU 110 and the ROM pack or RAM pack. The ROM pack inserted in the extension unit 50E may store specific characters and symbols for drawings, maps, chemistry, and mathematics as well as linguistic fonts other than English or Japanese, and character fonts such as Gothic and handwriting type faces so as to allow editing of a desirable series of characters. The battery backed-up RAM pack which information is freely written in may alternatively be inserted in the extension unit 50E. The RAM pack stores a greater amount of information than a memory capacity of an internal RAM area of the tape printing device to create a library of printing characters or to be used for information exchange with another tape printing device 1.

Character dot data read out of the mask ROM 118 or the extension unit 50E are input to an LCD controller 116A of a display control circuit 116 as well as the CPU 110.

Figure 16:
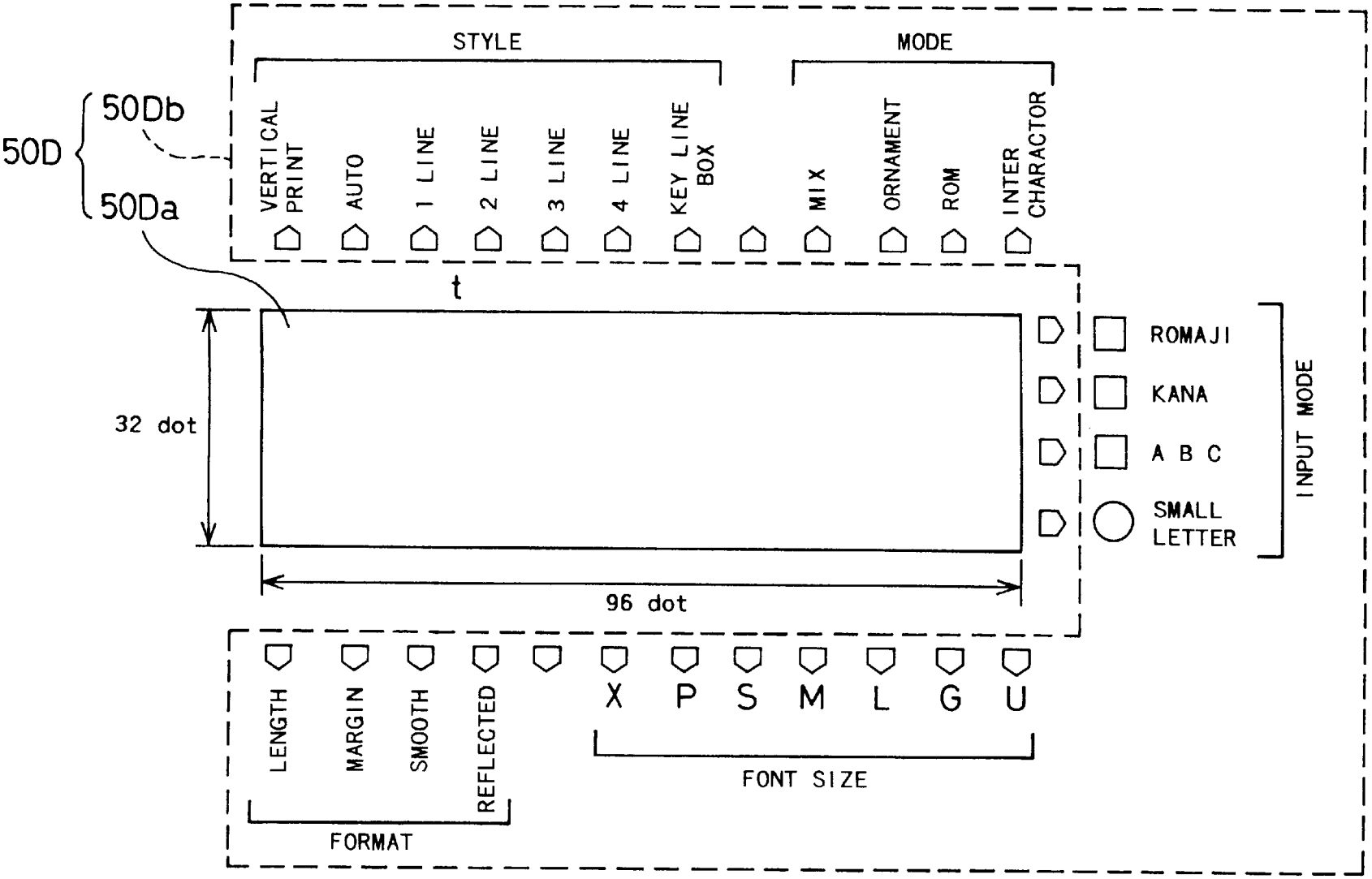
FIG. 16 shows a structure of a display unit 50D.

The display unit 50D controlled by the CPU 110 via the display control circuit 116 is laid under a transparent portion of the cover 50K. The user can thus see the display unit 50D through the cover 50K. The display unit 50D has two different electrode patterns on a liquid-crystal panel; that is, a dot matrix pattern of 32 (height)×96(width) dots and twenty eight pentagonal electrode patterns surrounding the dot matrix pattern, as shown in FIG. 16. An area of the dot matrix pattern is designated as a main display element 50Da for displaying a printing image while an area of the pentagonal electrode patterns is referred to as an indicator element 50Db.

The main display element 50Da is a liquid crystal display panel allowing a display of 32 dots in height×96 dots in width. In the embodiment, since a character font of 16 dots in height×16 dots in width is used for character input and editing, a display on the main display element 50Da includes six characters×two lines. Alternatively, the main display element 50Da may include four lines of letters when only an alphabetical font is used. Each character is shown as a positive display, a negative display, or a flickering display according to the editing process.

The display on the dot-matrix main display element 50Da is controlled according to the requirement. For example, a layout of a printing image may be displayed after a certain key input operation. When the user instructs display of a layout, as shown in FIG. 16, a tape width is shown as a negative display and a series of printing characters are displayed in white, where each dot of the main display element 50Da corresponds to 4×4 dots in printing. A whole length of the tape is displayed numerically as supplementary information of the printing image. When the layout of the printing image is larger than the area of the main display element 50Da, the whole layout may be observed and checked through vertical or horizontal scroll with cursor keys operation.

The indicator element 50Db surrounding the main display element 50Da displays a variety of functions executed by the tape printing device 1. Display elements teach corresponding to a pentagonal electrode pattern of the indicator element 50Db represent a variety of functions and conditions printed around the pentagonal patterns of the display unit 50D. These functions and conditions include a character input mode such as 'romaji' (Japanese in Roman characters) or 'small letter', a printing and editing style such as 'line number' and 'keyline box', and a print format like 'justification' or 'left-weight'. When a function or a condition is executed or selected, the display element corresponding to the function or condition lights up to inform the user.

The printer unit 50B of the tape printing device 1 includes the printing head 60 and the stepping motor 80 as mechanical constituents, and a printer controller 120 for controlling the mechanical constituents and a motor driver 122 as electrical constituents. The printing head 60 is a thermal head having ninety-six heating points arranged in a column at a pitch of 1/180 inch, and internally provided with the temperature detection circuit 60A for detecting the temperature and the voltage detection circuit 60B for detecting the supply voltage as described previously. The stepping motor 80 regulates a rotational angle by controlling a phase of a four-phase driving signal. A tape feeding amount of each step by the stepping motor 80 is set equal to 1/360 inch according to the structure of the gear train functioning as a reduction gear mechanism. The stepping motor 80 receives a two-step rotation signal synchronously with each dot printing executed by the printing head 60. The printer unit 50B thereby has a printing pitch of 180 dots/inch in the longitudinal direction of the tape as well as the direction of the tape width.

A detection switch 99 for detecting operation of the cutting mechanism is connected to a common line of connecting signal lines between the printer controller 120, the motor driver 122, and the CPU 110 as shown in FIG. 14. When the cutting mechanism is driven during printing operation, the detection switch 99 detects operation of the cutting mechanism and inactivates the printer unit 50B. Since signals are continuously sent from the CPU 110 to the printer controller 120 and the motor driver 122, printing may, however, be continued after the user interrupts to use the cutting mechanism.

Actuation of the cutting mechanism during a printing process interferes with normal feeding of the tape T. The detection switch 99 of the embodiment is thus directly connected with the common line of the motor driver 122 to forcibly cut the power off so as to immediately stop the printing process or more specifically the tape feeding. In an alternative structure, an output of the detection switch 99 may be input to the CPU 110, and the printer unit 50B is inactivated according to a software as is the case of untimely opening of the cover 50K. The detection switch 99 may be replaced by a mechanical structure which presses the clutch arm 80B according to the movement of the movable blade 98 to prevent rotation of the stepping motor 80 from being transmitted to the platen driving shaft 72.

The tape printing device 1 is further provided with a power unit 114, which receives a stable back-up or logic circuit 5V power from the battery BT by an RCC method using an IC and a transformer. The CPU 110 includes a port PB4 for regulating the voltage.

Under such a condition that the tape cartridge 10 thus constructed is not set in the tape printing device 1, the tape core 20 is pressed against the bottom wall 18 via a washer 23 (see FIG. 3) to be not rotatable. Non-rotatable structure of the tape core 20 effectively prevents looseness or slack of the tape T. The pair of circular films 20A adhering to the upper and lower sides of the tape core 20 have adhesive layers facing the tape T. Upper and lower sides of the tape T are thereby securely stuck to the films 20A.

As described above, the platen 12 is movably fitted in the elliptic apertures 16A and 18A of the top wall 16 and the bottom wall 18. When the user tries to press back the tape T pulled outside the tape cartridge 10 into the tape cartridge 10, the platen 12 moves towards the tape guide pin 26 to clamp the tape T between the platen 12 and the tape guide pin 26 (see FIG. 3). This interferes with a further movement of the tape T and effectively prevents the tape T from being forcibly pressed inside the tape cartridge 10. The guide element 10B arranged near the tape outlet 10A of the tape cartridge 10 ensures smooth feeding of the tape T held between the printing head 60 and the platen 12 even when a longitudinal end of the tape T enters a little inside the tape outlet 10A.

When the user tries to use the tape cutter 90 during printing operation, the detection switch 99 detects the movement of the tape cutter 90 before cutting the tape to stop rotation of the stepping motor 80 and power supply to the head body 65 immediately. The tape cutter 90 is thereby not used during feed of the tape T for printing. This effectively prevents the tape T from being stuck in the tape cartridge 10, thus improving usability of the tape printing device 1 and reducing labor required for maintenance.

Figure 17:
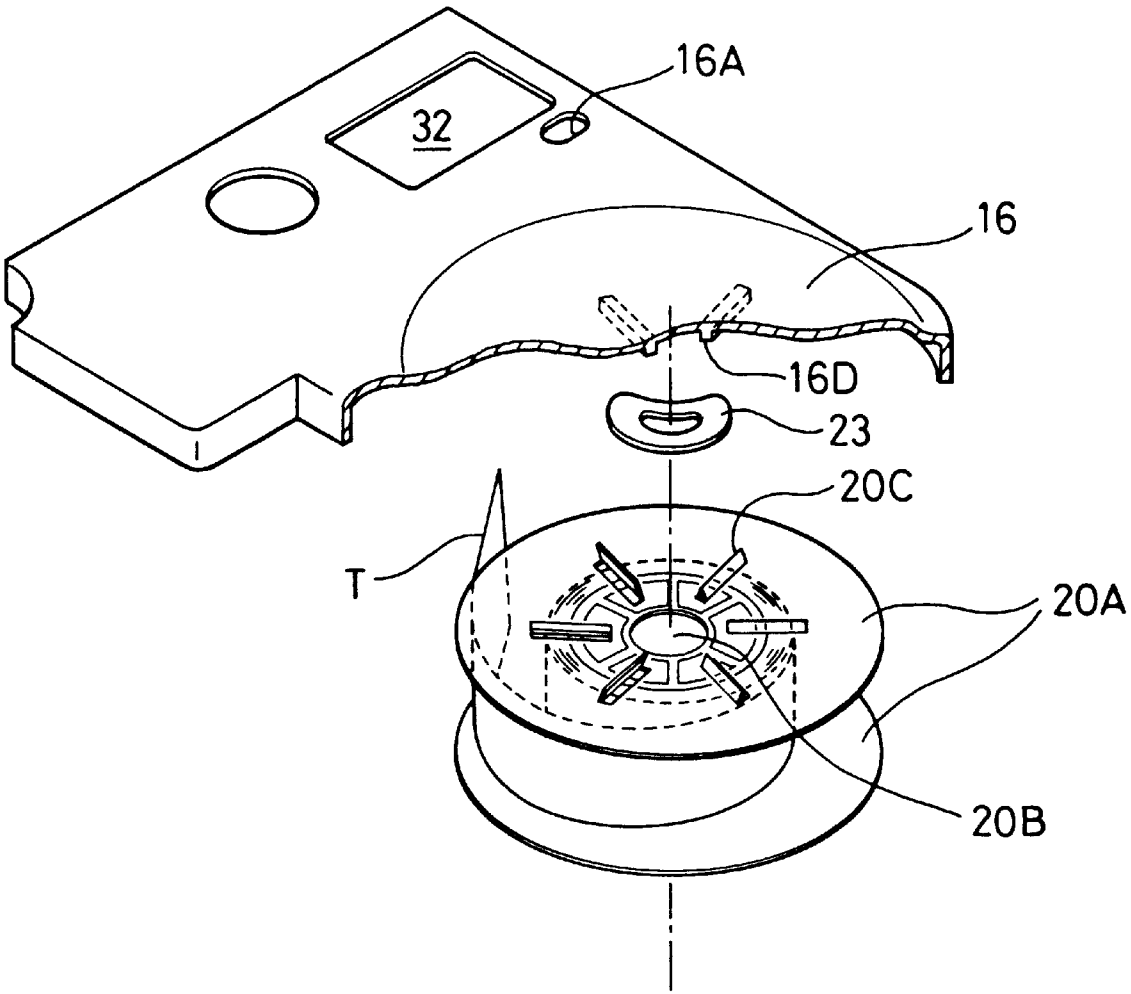
FIG. 17 is a perspective view illustrating another mechanism of preventing rotations of the tape core 20.

In this embodiment, the washer 23 presses the tape core 20 against the bottom wall 18 to prevent rotation of the tape core 20. Another structure may, however, be applied to prevent rotation of the tape core 20. For example, as shown in FIG. 17, the film 20A adhering to the upper end of the tape core 20 has a plurality of clicks 20C, which engage with a plurality of projections 16D formed on an inner face of the top wall 16 of the tape cartridge 10 only when the tape core 20 rotates in such a direction as to normally feed the tape T. This structure also effectively prevents the tape core 20 from being rotated in a wrong direction to loose the tape T. Such a click element or another anti-rotation structure may be formed on the lower end of the tape core 20 instead of the upper end shown in FIG. 17.

The tape cartridge 10 may accommodate a folded long tape T in place of the tape T wound on the tape core 20 as described above.

Under such a condition that the tape cartridge 10 is not set in the tape printing device 1, the first engagement elements 22A of the ink ribbon core 22 engage with the first engagement piece 18D formed on the bottom wall 18 of the tape cartridge 10 to prevent rotation of the ink ribbon core 22 (see FIGS. 3 and 4). In the same manner, the second engagement elements 24A of the ribbon winding core 24 engage with the second engagement piece 18H formed on the bottom wall 18 to prevent rotation of the ribbon winding core 24. This structure efficiently prevents slack of the ink ribbon R during delivery of the tape cartridge 10 without any protective sheet or element or any special casing for the tape cartridge 10. No use of protective elements makes the tape cartridge 10 free from faults or troubles due to non-removal of these elements. Engagement of the first engagement elements 22A with the first engagement piece 18D and that of the second engagement elements 24A with the second engagement piece 18H are automatically released by functions of the cone-shaped contact projections 70A and 70B (see FIG. 4) when the tape cartridge 10 is set in the tape printing device 1.

Each edge of the first engagement piece 18D and the second engagement piece 18H obliquely faces the first engagement elements 22A and the second engagement elements 24A to allow rotation of the ink ribbon R in a normal direction, that is, a direction not to slacken the ink ribbon R, while the tape cartridge 10 is not set in the tape printing device 1. Even when engagement of the first engagement elements 22A with the first engagement piece 18D or that of the second engagement elements 24A with the second engagement piece 18D is not completely released due to a worn-out or broken contact projection 70A or 70B or inappropriate setting of the tape cartridge 10 in the tape printing device 1, winding of the ink ribbon R for printing is normally implemented according to the above structure.

When the tape cartridge 10 once used for printing is detached from the tape cartridge holder unit 50A, the first engagement piece 18D and the second engagement piece 18H respectively re-engage with the first engagement elements 22A of the ink ribbon core 22 and the second engagement elements 24A of the ribbon winding core 24 to prevent rotation of the ink ribbon core 22 and the ribbon winding core 24, thus preventing undesirable slack of the ink ribbon R. Since a tape cartridge 10 which has been used for printing but is still usable is often removed from the tape printing device 1 to be replaced with another tape cartridge having a different tape width, this anti-slack structure of the ink ribbon core 22 and the ribbon winding core 24 is significantly useful.

As described previously, each edge of the first engagement piece 18D and the second engagement piece 18H obliquely faces the first engagement elements 22A and the second engagement elements 24A to allow rotation of the ink ribbon core 22 and the ribbon winding core 24 in such a direction as to reduce slack of the ink ribbon R even after the tape cartridge 10 is detached from the tape cartridge holder unit 50A. This allows the user to rotate the ribbon winding core 24 with a screwdriver to remove slack of the ink ribbon R.

In the tape printing device 1 of the embodiment, when the user forcibly pulls out the tape T, the clutch arm 80B rotates counterclockwise in the drawing of FIG. 11 to release an engagement of the second gear 82 with the third gear 83. This makes the platen 12 free from the force of the stepping motor 80. The platen driving shaft 72 of the platen 12 and the ribbon winding core driving shaft 74 of the ribbon winding core 24 thus rotate according to pull-out movement of the tape T so as to prevent the ink ribbon R from being slackened or pulled out of the tape cartridge 10 due to forcible movement of the tape T.

Although the tape cartridge 10 of the embodiment accommodates both the ink ribbon R and the tape T, a tape cartridge accommodating only the tape T and an ink ribbon cartridge accommodating only the ink ribbon R may be manufactured separately.

The structure of the invention is applicable to a wide range of printing devices with ink ribbon, for example, to an ink ribbon cartridge accommodating a thermal transfer ink ribbon and a word processor using the ink ribbon cartridge, or to a dot-impact printer and an ink ribbon used therein.

A second embodiment of the invention is described hereinafter. A cartridge 210 of the second embodiment is schematically illustrated in FIGS. 18 through 21. This cartridge 210 is detachably set in the printing device 1 of the first embodiment.

As shown in FIGS. 18 through 21, the cartridge 210 has a cartridge case 201 consisting of an upper case 201*a* and a is lower case 201*b*, which receives a variety of elements including a tape core 202 and an ink ribbon core 207 therein. The tape core 202 has a tape 203 wound thereon and is set around a projection 201*c* in the lower case 201*b*.

A bearing hole 202*b* of the tape core 202 receives an anti-inversion spring 204, which has one end 204*a* extending to be fitted in a slit 201*d* of the projection 201*c* of the lower case 201*b*. The cartridge 210 further accommodates a platen 205 receiving a driving force of a printing device (not shown) to feed the tape 203 out and receiving a pressure of a printing head (not shown) during printing operation, and a ribbon winding core 207 for winding an ink ribbon 206 used for printing. The cartridge 210 is mounted on a cartridge holder unit 208 of a printing device or a tape writer (not shown). The position of the cartridge 210 is determined by the projection 201*c* of the lower case 201*b* and a positioning projection 208*a* formed on the cartridge holder unit 208.

Figure 21:
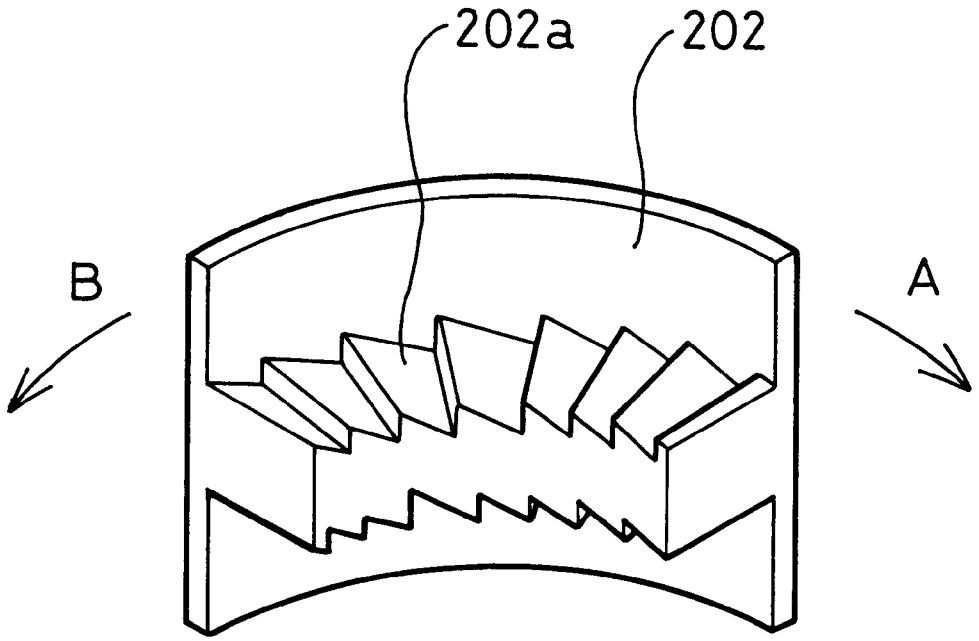
FIG. 21 is a perspective view illustrating an essential part of a tape core 202 in the second embodiment.

The cartridge 210 of the second embodiment has a structure below for preventing a longitudinal end of the tape 203 from being reversely moved back into the cartridge case 201. As clearly seen in FIG. 21, the tape core 202 has a ratchet groove 202*a* around the bearing hole 202*b*. The one end 204*a* of the anti-inversion spring 204 engages with the ratchet groove 202*a* to interfere with rotation of the tape core 202 in a direction shown by the arrow B. The ratchet groove 202*a* has a plurality of teeth formed in one direction as shown in FIG. 21 allows the tape core 202 to press up the spring 204*a* and freely rotate in a direction shown by the arrow A. This ratchet mechanism of the tape core 202 engaging with the one end 204*a* of the anti-inversion spring 204 allows rotation of the tape core 202 only in the direction A, thus preventing the end of the tape 203 from being reversely moved back into the cartridge case 201. Engagement of the one end 204*a* of the anti-inversion spring 204 with the slit 201*d* of the projection 201*c* formed in the lower case 201*b* of the cartridge 210 effectively prevents the anti-inversion spring 204 from rotating integrally with the tape core 202.

The cartridge 210 of the second embodiment further includes a supplementary structure to ensure anti-inversion of the tape core 202.

Figure 18:
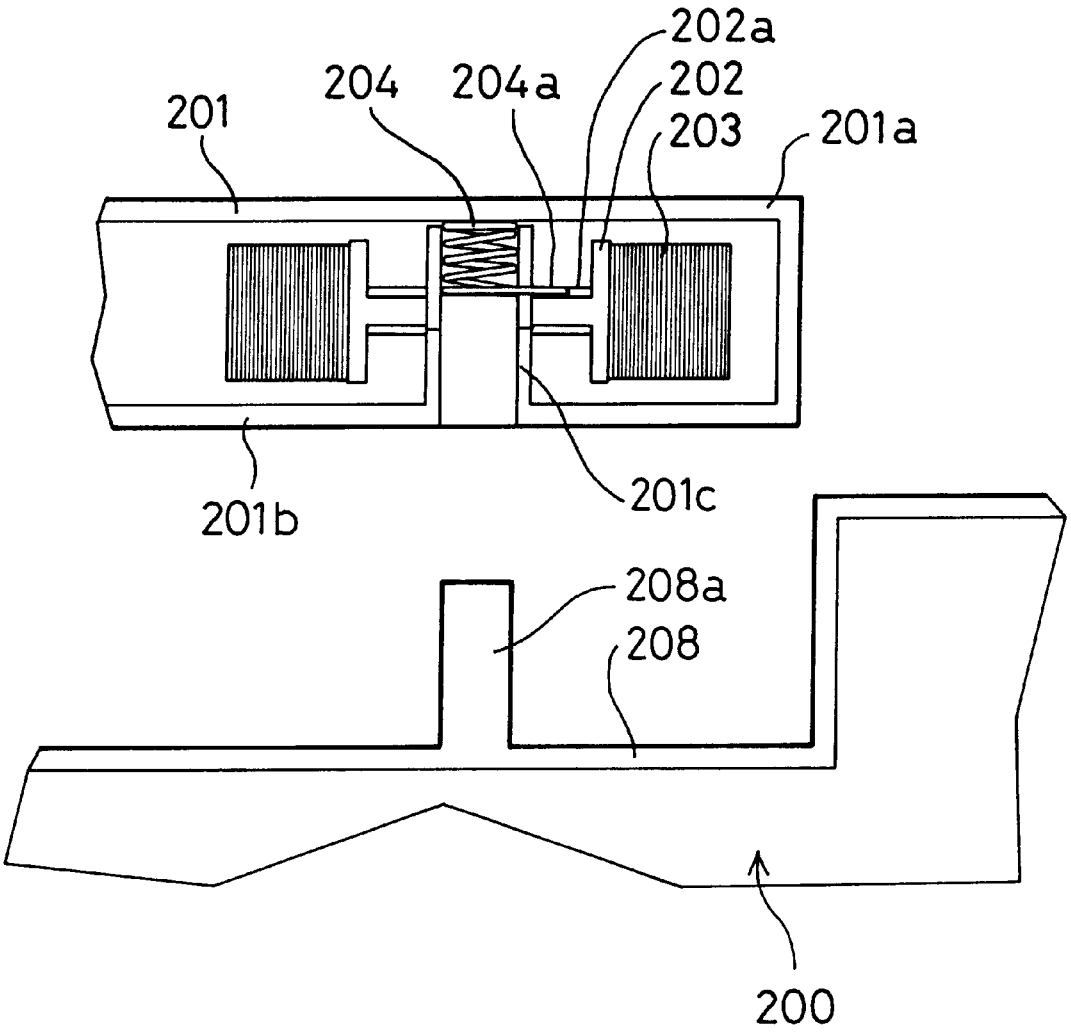
FIG. 18 is a cross sectional view showing a cartridge 210 of a second embodiment according to the invention.
Figure 19:
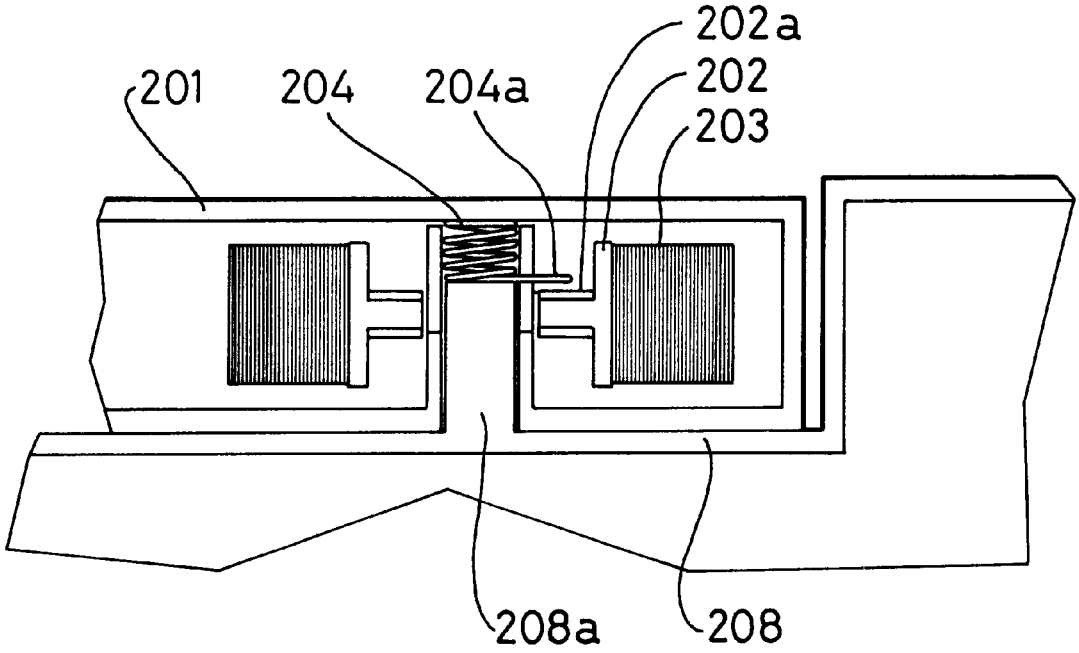
FIG. 19 is a cross sectional view illustrating the cartridge 210 set in the tape writer 1.
Figure 20:
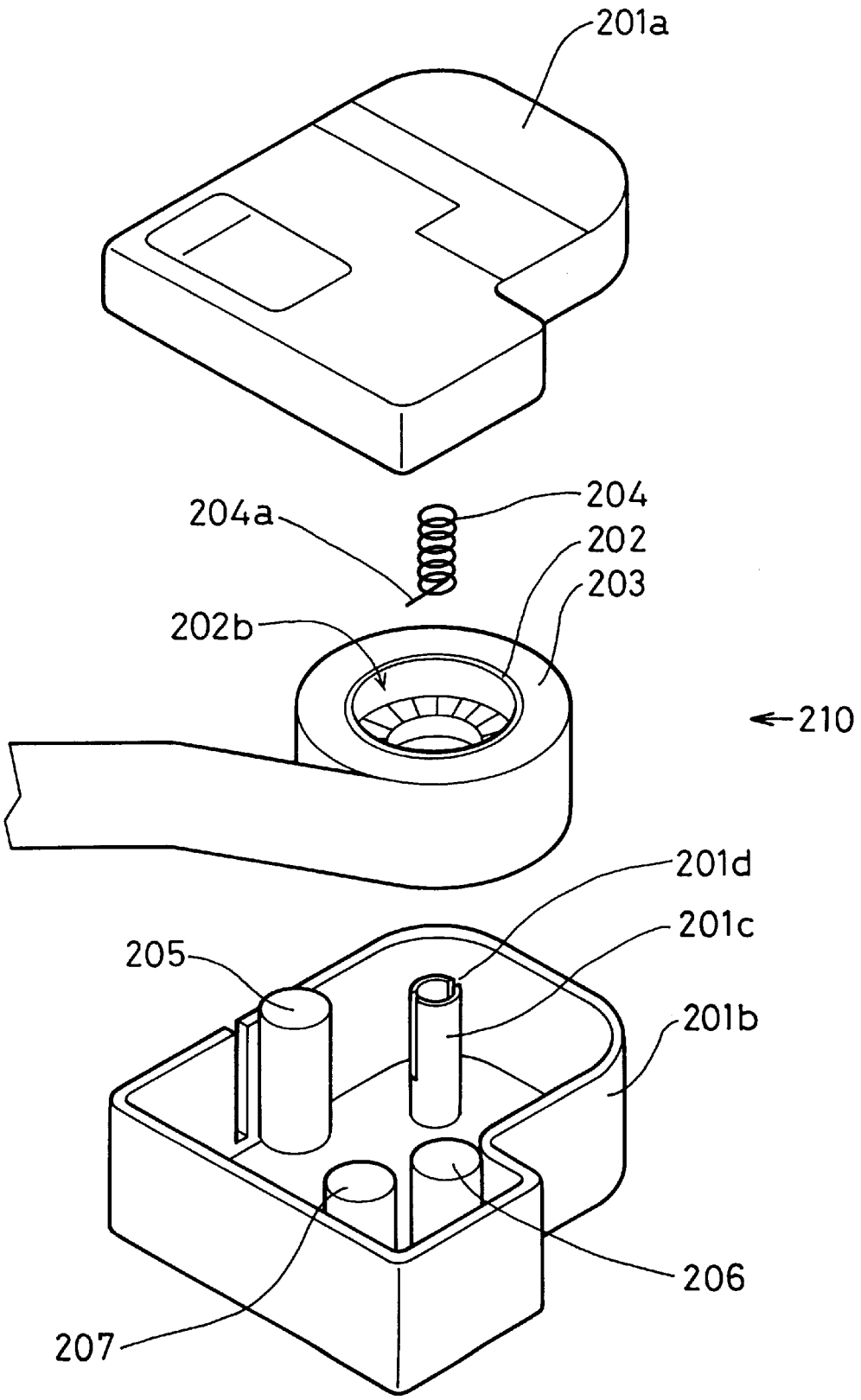
FIG. 20 is a decomposed perspective view of the cartridge 210.

The cartridge holder unit 208 has the positioning projection 208*a* as clearly seen in FIGS. 18 and 19. When the cartridge 210 is set on the cartridge holder unit 208, the positioning projection 208*a* functions to lift the anti-inversion spring 204 up and release the engagement of the one end 204*a* of the anti-inversion spring 204 with the ratchet groove 202*a,* thus allowing free rotation of the tape core 202. Undesirable reverse movement of the tape 203 occurs when the cartridge 210 is not set in a tape printing device 200, for example, during delivery or accidental fall of the cartridge 210. Release of the engagement of the spring 204 with the ratchet groove 202*a* in the cartridge 210 set on the cartridge holder unit 208 preferably decreases a force required for tape feeding and reduces a torque load applied on a platen driving motor (not shown).

Although a coiled spring is used as the anti-inversion spring 204 in the second embodiment, another spring such as a leaf spring or another element having similar effects may be used instead of the coiled spring.

Figure 22:
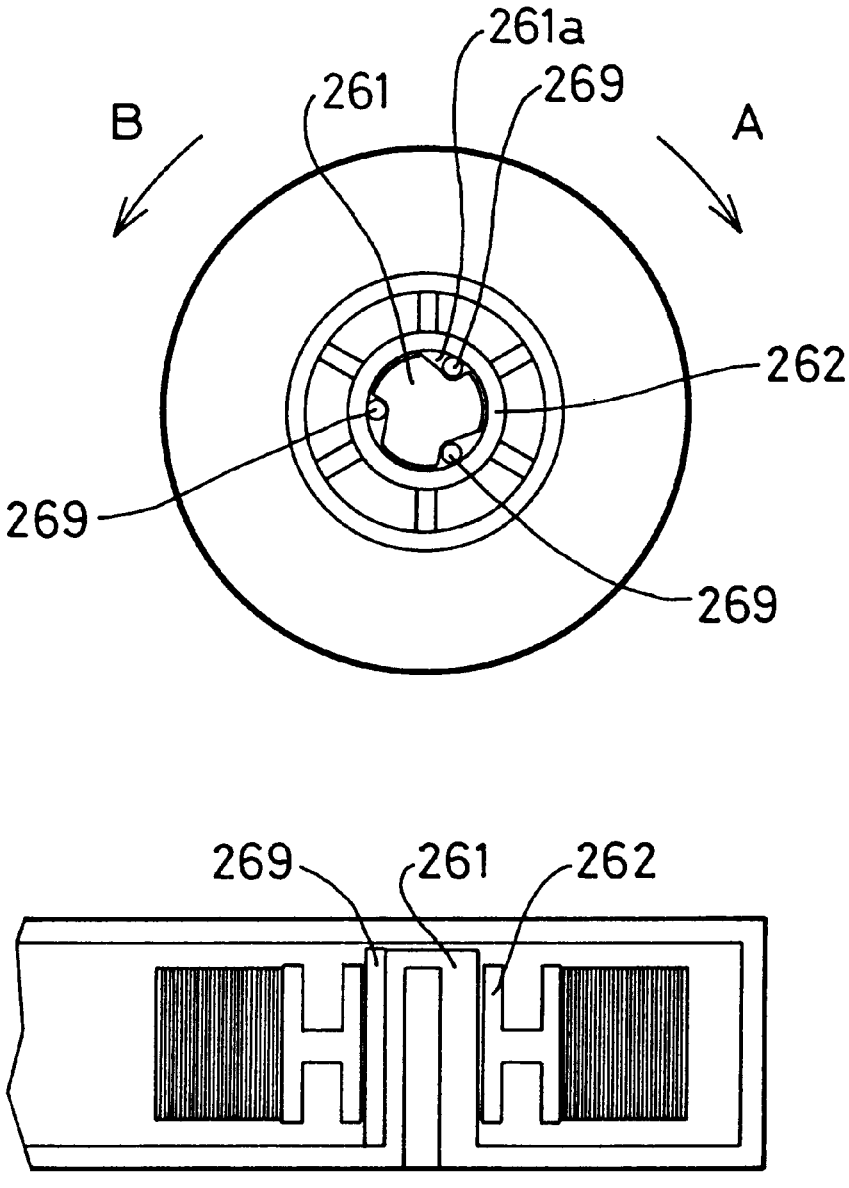
FIG. 22 schematically shows a clutch mechanism having a plurality of wedge-shaped grooves in another tape cartridge.

A third embodiment of the invention is described according to FIG. 22. The structure of the third embodiment includes a plurality of clutch members 269 formed between a tape core 262 and a tape core guide face of an upright shaft member 261 formed on a cartridge case. An upright shaft member 261 has three grooves 261*a* formed on an outer face of the shaft member 261 and extending along the shaft member 261. When the tape core 262 is set around the shaft member 261, the three clutch members 269 are located in spaces defined by the three grooves 261*a* and an inner surface of the tape core 262. The space formed by each groove 261*a* of the shaft member 261 has a wedge-like shape in a circumferential direction of the tape core 262 as clearly seen in FIG. 22. When the tape core 262 is rotated in a direction shown by the arrow A, the clutch members 269 do not enter the wedge-shaped spaces to allow free rotation of the tape core 262. When the tape core 262 is rotated in a direction shown by the arrow B, on the other hand, the clutch members 269 are fitted in the wedge-shaped spaces to interfere with rotation of the tape core 262.

Figure 23:
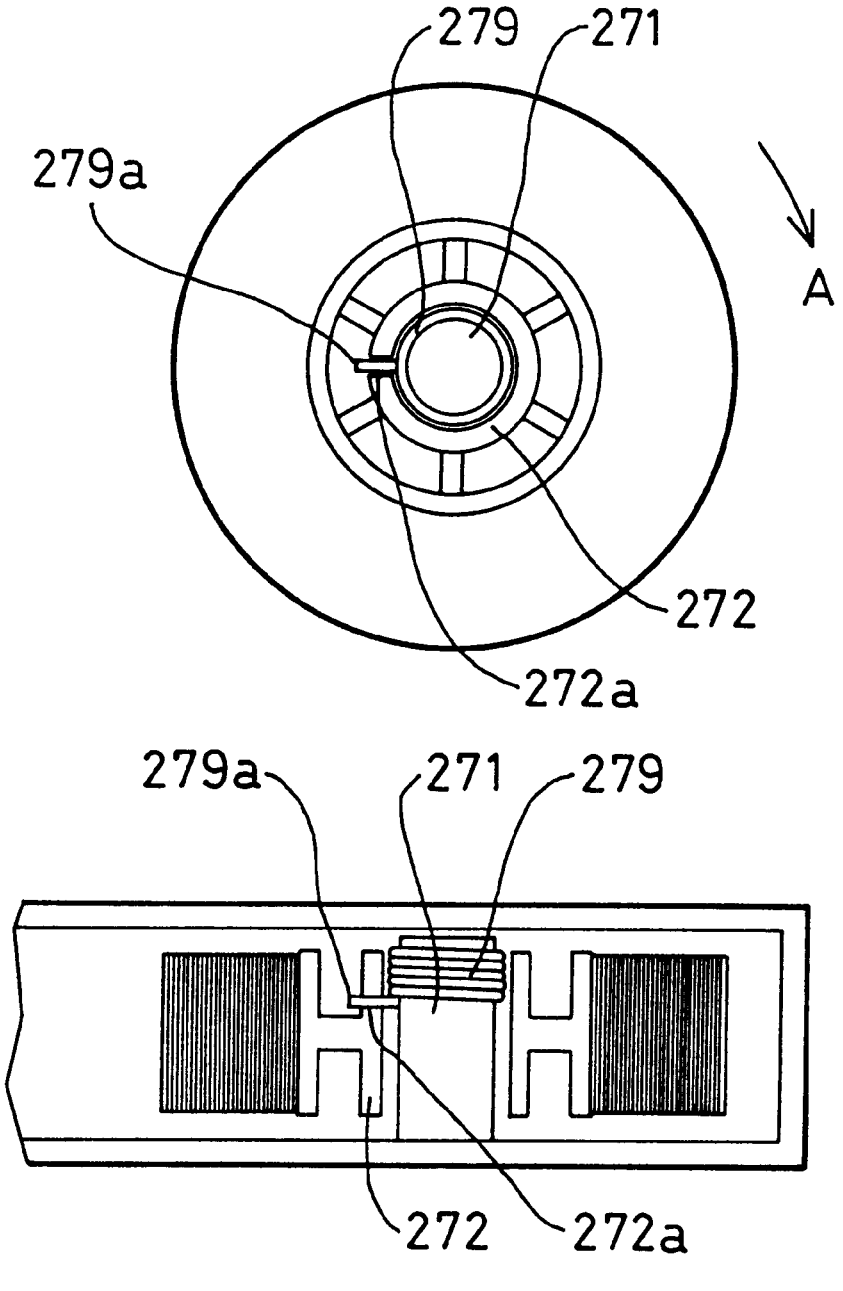
FIG. 23 shows still another tape cartridge having a coil spring.

A fourth embodiment of the invention is described according to FIG. 23. The structure of the fourth embodiment includes another clutch mechanism for allowing rotation of a tape core 272 only in one direction. As shown in FIG. 23, the tape core 272 having a coil spring 279 therein is set around an upright shaft 271 formed in a cartridge case. One end 279*a* of the coil spring 279 engages with a groove 272*a* of the tape core 272. The coil spring 279 has an inner diameter a little greater than an outer diameter of the shaft 271 and is thereby set around the shaft 271 with a predetermined clearance. When the tape core 272 is rotated in a direction shown by the arrow A, the inner diameter of the coil spring 279 is expanded to allow free rotation of the tape core 272. When the tape core 272 is rotated in an opposite direction, on the other hand, the inner diameter of the coil spring 279 is contracted to clamp the shaft 271 so as to interfere with rotation of the tape core 272.

Figure 24:
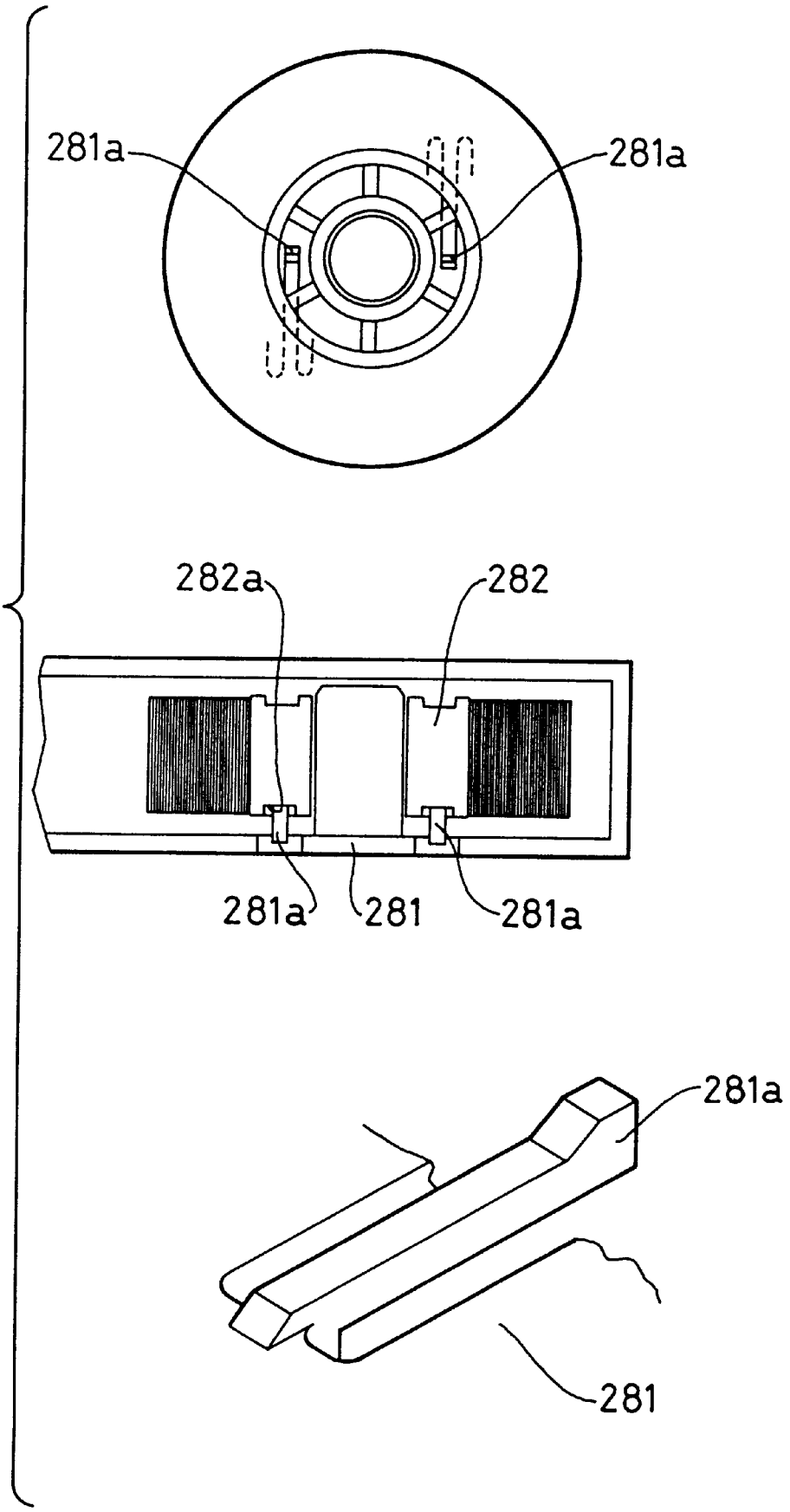
FIG. 24 shows another tape cartridge having a clutch pawl.

A fifth embodiment of the invention is described according to FIG. 24. The structure of the fifth embodiment includes a pair of locking pawls 281*a* formed on a bottom surface of a cartridge case 281 to engage with a pair of grooves 282*a* of a tape core 282. Either or both of the locking pawls 281*a* and the grooves 282*a* have surfaces inclined in a predetermined direction to form a ratchet mechanism allowing rotation of the tape core 282 only in one direction. In the example of FIG. 24, each locking pawl 281*a* has an inclined surface.

The structure of the tape cartridge in each of the above embodiments effectively prevents a tape from being reversely moved back into a cartridge case. This allows simple handling and storage of the tape cartridge which is detachably set in a printing device.

There may be many other changes, modifications, and alterations without departing from the scope or spirit of essential characteristics of the invention, and it is thereby clearly understood that the above embodiments are only illustrative and not restrictive in any sense. The spirit and scope of the present invention is only limited by the terms of the appended claims.

What is claimed is:

1. A tape printing device formed to detachably receive a cartridge including a ribbon storage core having a print ribbon stored thereon and a ribbon winding core formed for storage of the print ribbon after printing use thereof, and a printing tape cooperating with the print ribbon to print at least one character on the printing tape, said printing device comprising:

a printing head configured to print said at least one character on the printing tape, and for cooperating with a platen to hold the printing tape and the print ribbon in abutting contact therebetween;

a printing synchronous driving mechanism configured to drive said printing tape and said print ribbon substantially in synchronous relationship under printing conditions; and a non-printing synchronous mechanism cooperating with said driving mechanism to decouple said driving mechanism from said platen in a manner synchronizing winding movement of said print ribbon substantially with a forcible pull-out movement of said printing tape under non-printing conditions.

2. The printing device in accordance with claim 1, wherein said driving mechanism includes a stepper motor for incremental stepped driving movement of the platen.

3. The printing device in accordance with claim 2, wherein said synchronous mechanism further includes a first transmission mechanism configured to transmit rotation of said stepper motor to said platen.

4. The printing device in accordance with claim 3, wherein said synchronous mechanism further includes a second transmission mechanism configured to transmit said rotation of said stepper motor to said ribbon winding core.

5. The printing device in accordance with claim 4, wherein said second transmission mechanism is synchronously coupled to said first transmission mechanism for said driving of said printing tape and said print ribbon substantially in said synchronous relationship under printing conditions.

6. The printing device in accordance with claim 5, wherein said synchronous mechanism further includes a clutch assembly disposed between said stepper motor and said first transmission mechanism for releasably coupling the first transmission mechanism to said stepper motor.

7. The printing device in accordance with claim 6, wherein said clutch assembly includes a third transmission mechanism movable between an engaged position, driveably engaging the stepper motor with the first transmission mechanism when said stepper motor is actuated for said rotation thereof, and a disengaged position, disengaging the first transmission mechanism from the stepper motor during movement caused by said pull-out movement of said printing tape.

8. The printing device in accordance with claim 7, wherein said clutch assembly farther includes a clutch arm having one end pivotally coupled to a shaft by a predetermined friction such that during actuation of said stepper motor, said clutch arm urges said third transmission mechanism toward the engaged position.

9. The printing device in accordance with claim 5, wherein said first transmission mechanism includes a first gear train, and said second transmission mechanism includes a second gear train driveably coupled to said first gear train.

10. The printing device in accordance with claim 1, wherein said print ribbon extends along a predetermined path in said cartridge, and extending at least partially around said printing head when said cartridge is received in the printing device.

11. The printing device in accordance with claim 10, wherein said printing head is pivotally mounted to said printing device between a non-contacting condition and a contacting condition, urging the printing ribbon into abutting contact with the printing tape and the platen.

12. A tape printing assembly comprising:

a tape print cartridge including a ribbon storage core having a print ribbon stored thereon and a ribbon winding core formed for storage of the print ribbon after printing use thereof, and a printing tape cooperating with the print ribbon to print at least one character on the printing tape;

a driving mechanism; and a synchronous mechanism configured to driveably couple to said driving mechanism to drive said printing tape and said print ribbon substantially in synchronous relationship under printing conditions and to decouple from said driving mechanism during a forcible pull-out movement of said printing tape, under non-printing conditions, while maintaining said synchronous relationship with said printing ribbon.

13. The printing assembly in accordance with claim 12, further including:

a cartridge holder unit formed to detachably receive said print cartridge therein; and a printing head extending into the cartridge holder unit for movement between a non-contacting position, enabling removal and receipt of said tape cartridge, and a contacting position, cooperating with a platen to hold the printing tape and the print ribbon in abutting contact therebetween.

14. The printing assembly in accordance with claim 13, wherein said driving mechanism includes a stepper motor for incremental stepped driving movement of the platen.

15. The printing assembly in accordance with claim 14, wherein said synchronous mechanism includes a first transmission device operably disposed between the stepper motor and the platen to transmit rotation of a shaft of said stepper motor to said platen.

16. The printing assembly in accordance with claim 15 wherein said synchronous mechanism further includes a second transmission device formed and configured to transmit said rotation of said shaft to said ribbon winding core.

17. The printing assembly in accordance with claim 16, wherein said second transmission device is synchronously intercoupled to said first transmission device to enable said driving of said printing tape and said print ribbon substantially in said synchronous relationship under printing conditions.

18. The printing assembly in accordance with claim 17, wherein said synchronous mechanism includes a clutch assembly disposed between said shaft of said stepper motor and said first transmission device to releasably couple the first transmission device to said stepper motor.

19. The printing assembly in accordance with claim 18, wherein said clutch assembly includes a third transmission device movable between an engaged position, driveably engaging the stepper motor shaft with the first transmission device when said stepper motor is actuated for said rotation of the shaft, and a disengaged position, disengaging the first transmission device from the stepper motor during movement caused by said pull-out movement of said printing tape.

20. The printing assembly in accordance with claim 19, wherein said clutch assembly further includes a clutch arm having one end pivotally coupled to said shaft by a predetermined friction such that during actuation of said stepper motor, said clutch arm urges said third transmission device toward the engaged position.

21. The printing assembly in accordance with claim 13 wherein said print ribbon extends along a predetermined path in said cartridge, and further extends at least partially around said printing head when said cartridge is received in the printing assembly.

22. The printing assembly in accordance with claim 21, wherein said printing head is pivotally mounted to said printing assembly between the non-contacting condition and a contacting condition, urging the printing ribbon into abutting contact with the printing tape and the platen.

23. A method for printing on a print tape of a tape cartridge detachably received in a tape printing device, said cartridge including a ribbon storage core having a print ribbon stored thereon and a ribbon winding core formed for storage of the print ribbon after printing use thereof, said printing device including a printing head configured to cooperate with a platen to hold the printing tape and the print ribbon in abutting contact therebetween to print at least one character on the printing tape, said method comprising:

driving said printing tape and said print ribbon substantially in synchronous relationship through a driving mechanism coupled to the platen during printing conditions; and in the event of a forcible pull-out movement of said printing tape during non-printing conditions, decoupling said driving mechanism from said platen which enable rotative movement of said platen in a manner synchronizing movement of said print ribbon substantially with the pull-out movement of said printing tape for synchronized winding of said winding core.

24. The method according to claim 23, further includes:

moving the printing head from a non-contacting position, enabling removal and receipt of said tape cartridge, to a contacting position, cooperating with the platen to hold the printing tape and the print ribbon in abutting contact therebetween.

25. The method according to claim 24, wherein said driving includes incrementally rotating the platen through a stepper motor.

26. The method according to claim 25, further including transmitting rotation of a shaft of said stepper motor to said platen through a first transmission device.

27. The method according to claim 26, further including transmitting the rotation of said shaft to said ribbon winding core through a second transmission device synchronously inter-coupled to said first transmission device.

28. The method according to claim 27, wherein said synchronizing includes releasably coupling the first transmission device to said stepper motor between an engaged position, driveably engaging the stepper motor shaft with the first transmission device when said stepper motor is actuated for said rotation of the shaft, and a disengaged position, disengaging the first transmission device from the stepper motor during movement caused by said pull-out movement of said printing tape.

29. The method according to claim 24, wherein said moving the printing head includes pivotally moving said printing head between the non-contacting condition and the contacting condition.

30. A tape printing device formed to detachably receive a cartridge including a ribbon storage core having a print ribbon stored thereon and a ribbon winding core formed for storage of the print ribbon after printing use thereof, and a printing tape cooperating with the print ribbon to print at least one character on the printing tape, said printing device comprising:

a printing head configured to print said at least one character on the printing tape;

a driving mechanism;

a synchronous mechanism configured to move said printing tape and said print ribbon substantially in synchronous relationship;

a transmission assembly configured to driveably couple said synchronous mechanism to said driving mechanism under printing conditions, and to decouple said synchronous mechanism from said driving mechanism during a forcible pull-out movement of said printing tape, under non-printing conditions, while maintaining said synchronous relationship with said printing ribbon.

31. The printing device in accordance with claim 30, wherein said synchronous mechanism includes a first transmission mechanism configured to transmit the driving motion of said driving mechanism to a platen cooperating with the printing head to hold the printing tape and the print ribbon in abutting contact therebetween platen.

32. The printing device in accordance with claim 31, wherein said driving mechanism includes a stepper motor for incremental stepped driving movement of the platen.

33. The printing device in accordance with claim 31, wherein said synchronous mechanism further includes a second transmission mechanism configured to transmit the driving motion of said driving mechanism to said ribbon winding core.

34. The printing device in accordance with claim 33, wherein said transmission assembly is disposed between said driving mechanism and said first transmission mechanism for releasably coupling the first transmission mechanism to said driving mechanism.

35. The printing device in accordance with claim 34, wherein said transmission assembly includes a third transmission mechanism movable between an engaged position, driveably engaging the driving mechanism with the first transmission mechanism when said driving mechanism is actuated for said driving movement thereof, and a disengaged position, disengaging the first transmission mechanism from the driving mechanism during movement caused by said pull-out movement of said printing tape.

36. The printing device in accordance with claim 35, wherein said transmission assembly further includes a clutch arm having one end pivotally coupled to a shaft by a predetermined friction such that during actuation of said driving mechanism, said clutch arm urges said third transmission mechanism toward the engaged position.

37. A method for printing on a print tape of a tape cartridge detachably received in a tape printing device, said cartridge including a ribbon storage core having a print ribbon stored thereon and a ribbon winding core formed for storage of the print ribbon after printing use thereof, said printing device including a printing head configured to cooperate with a platen to hold the printing tape and the print ribbon in abutting contact therebetween to print at least one character on the printing tape, said method comprising:

coupling said platen to a driving mechanism for driving said printing tape and said print ribbon substantially in synchronous relationship during printing conditions; and in the event of a forcible pull-out movement of said printing tape during non-printing conditions, decoupling said platen from said driving mechanism to enable synchronizing movement of said print ribbon substantially with the pull-out movement of said printing tape for synchronized winding of said winding core.

38. The method according to claim 37, wherein said coupling includes driveably engaging a first transmission device to said driving mechanism when said driving mechanism is actuated, and said decoupling includes disengaging the first transmission device from the driving mechanism during movement caused by said pull-out movement of said printing tape.

* * * * *

UNITED STATES PATENT AND TRADEMARK OFFICE

CERTIFICATE OF CORRECTION

PATENT NO. : 6,126,344
DATED : October 3, 2000
INVENTOR(S) : Takayama et al.

It is certified that error appears in the above-identified patent and that said Letters Patent is hereby corrected as shown below:

Claim 8,
Line 3, change "farther" to -- further --.

Signed and Sealed this

Twenty-fifth Day of December, 2001

*Attest:*

*Attesting Officer*

JAMES E. ROGAN
*Director of the United States Patent and Trademark Office*